US009821202B2

(12) United States Patent
Hettinger et al.

(10) Patent No.: US 9,821,202 B2
(45) Date of Patent: Nov. 21, 2017

(54) WEDGE TYPE GOLF CLUB HEAD

(71) Applicant: Acushnet Company, Fairhaven, MA (US)

(72) Inventors: Ronald K. Hettinger, Oceanside, CA (US); Kevin Tassistro, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 1 day.

(21) Appl. No.: 15/130,719

(22) Filed: Apr. 15, 2016

(65) Prior Publication Data

US 2016/0228751 A1 Aug. 11, 2016

Related U.S. Application Data

(63) Continuation of application No. 14/318,781, filed on Jun. 30, 2014, which is a continuation-in-part of application No. 14/071,343, filed on Nov. 4, 2013, now Pat. No. 9,211,450, which is a continuation of application No. 12/957,562, filed on Dec. 1, 2010, now Pat. No. 8,579,729, which is a (Continued)

(51) Int. Cl.
*A63B 53/00* (2015.01)
*A63B 53/04* (2015.01)

(52) U.S. Cl.
CPC ..... *A63B 53/047* (2013.01); *A63B 53/0475* (2013.01); *A63B 2053/005* (2013.01); *A63B 2053/0408* (2013.01); *A63B 2053/0412* (2013.01); *A63B 2053/0433* (2013.01); *A63B 2053/0445* (2013.01); *A63B 2053/0479* (2013.01); *A63B 2053/0491* (2013.01)

(58) Field of Classification Search
USPC ..... 473/324–350
See application file for complete search history.

(56) References Cited

U.S. PATENT DOCUMENTS 645,942 A 3/1900 Cran
1,453,503 A 5/1923 Holmes
(Continued)

FOREIGN PATENT DOCUMENTS

EP 1082976 3/2001
JP 2265579 10/1990
(Continued)

OTHER PUBLICATIONS

JP H10-244025—Machine Translation.
Jackson, J., The Modern Guide to Golf Clubmaking, 1987, p. 237, Dynacraft Golf Products, Inc., Neward, Ohio, USA.

*Primary Examiner* — Alvin Hunter
(74) *Attorney, Agent, or Firm* — Randy K. Chang

(57) ABSTRACT

A wedge type golf club head is disclosed herein where the wedge type golf club head has enhanced performance characteristics such as improved backspin, ball speed, and launch angle. More specifically, the present invention relates to a wedge type golf club head having an adjustable center of gravity, where the center of gravity may be adjusted based on different backing profiles that comprises at least one hollow chamber. The wedge type golf club head disclosed above may also have a thickened topline, wherein the thickness of the topline progressively changes as a function of the loft angle of the wedge type golf club head.

9 Claims, 14 Drawing Sheets

Related U.S. Application Data continuation-in-part of application No. 12/832,488, filed on Jul. 8, 2010, now Pat. No. 8,491,414, which is a continuation-in-part of application No. 12/474,316, filed on May 29, 2009, now Pat. No. 8,187,120.

(56) References Cited

U.S. PATENT DOCUMENTS 1,642,462 A 9/1927 Reach
1,835,718 A * 12/1931 Morton ..... A63B 53/04 473/328
2,007,377 A * 7/1935 Link ..... A63B 53/04 473/350
2,332,342 A 3/1940 Reach
2,254,528 A * 9/1941 Hoare ..... A63B 53/04 473/328
D141,769 S * 7/1945 Newsome ..... 473/345
2,460,445 A 2/1949 Bigler
2,784,969 A 3/1957 Brandon
3,419,275 A 12/1968 Winkleman
3,606,327 A 9/1971 Gorman
3,655,188 A 4/1972 Solheim
3,751,035 A * 8/1973 Lockwood ..... A63B 53/04 473/290
3,845,960 A 11/1974 Thompson
3,961,796 A 6/1976 Thompson
3,979,122 A 9/1976 Belmont
4,145,052 A 3/1979 Janssen et al.
4,147,349 A 4/1979 Jeghers
4,180,269 A 12/1979 Thompson
4,211,416 A * 7/1980 Swanson ..... A63B 53/04 473/242
4,247,105 A 1/1981 Jeghers
4,322,083 A 3/1982 Imai
4,326,326 A 4/1982 MacDonald
4,540,178 A 9/1985 Johnson et al.
4,607,846 A 8/1986 Perkins
4,708,347 A 11/1987 Kobayashi
4,802,672 A 2/1989 Long
4,836,550 A 6/1989 Kobayashi
4,869,507 A 9/1989 Sahm
4,941,666 A 7/1990 Suganuma
5,011,151 A 4/1991 Antonious
5,013,041 A 5/1991 Sun et al.
5,050,879 A 9/1991 Sun et al.
5,110,131 A * 5/1992 Long ..... A63B 53/00 473/349
D327,109 S * 6/1992 Hardman ..... D21/748
5,120,062 A * 6/1992 Scheie ..... A63B 53/04 473/314
D329,481 S * 9/1992 Hunt ..... D21/750
5,199,707 A 4/1993 Knox
5,312,106 A 5/1994 Cook
5,326,105 A 7/1994 Fenton, Jr.
5,366,222 A 11/1994 Lee
5,385,348 A 1/1995 Wargo
5,421,577 A 6/1995 Kobayashi
5,429,353 A * 7/1995 Hoeflich ..... A63B 53/04 473/291
5,437,088 A 8/1995 Igarashi
5,439,223 A 8/1995 Kobayashi
D362,887 S * 10/1995 Blough ..... D21/747
D364,435 S * 11/1995 Wood ..... D21/750
D368,753 S * 4/1996 Blough ..... D21/750
5,547,426 A * 8/1996 Wood ..... A63B 53/04 473/290
5,629,475 A 5/1997 Chastonay
5,643,106 A * 7/1997 Baird ..... A63B 53/04 473/328
5,655,976 A 8/1997 Rife
5,688,189 A 11/1997 Bland
5,716,292 A 2/1998 Huang
5,728,010 A * 3/1998 Hsu ..... A63B 53/0487 473/324
5,749,794 A 5/1998 Kobayashi et al.
5,776,009 A 7/1998 McAtee
5,803,830 A 9/1998 Austin et al.
5,804,272 A 9/1998 Schrader
5,807,186 A 9/1998 Chen
5,890,971 A 4/1999 Shiraishi
5,913,735 A 6/1999 Kenmi
5,938,540 A 8/1999 Lu
6,015,354 A 1/2000 Ahn et al.
6,045,455 A 4/2000 Kosmatka et al.
6,086,485 A 7/2000 Hamada et al.
6,179,726 B1 1/2001 Satoh et al.
6,206,790 B1 3/2001 Kubica et al.
6,224,494 B1 5/2001 Patsky
6,290,607 B1 9/2001 Gilbert et al.
6,290,609 B1 9/2001 Takeda
6,344,000 B1 2/2002 Hamada et al.
6,368,232 B1 4/2002 Hamada et al.
6,530,846 B1 * 3/2003 Mase ..... A63B 53/00 473/290
6,533,679 B1 3/2003 McCabe et al.
6,554,722 B2 4/2003 Erickson et al.
6,569,029 B1 5/2003 Hamburger
6,623,374 B1 * 9/2003 Helmstetter ..... A63B 53/04 473/291
6,638,183 B2 10/2003 Takeda
6,641,491 B1 11/2003 Schillaci
6,679,784 B2 1/2004 Mase
6,719,642 B2 * 4/2004 Wahl ..... A63B 53/04 473/291
6,769,998 B2 * 8/2004 Clausen ..... A63B 53/0466 473/342
6,793,591 B2 9/2004 Takeda
6,811,496 B2 11/2004 Wahl et al.
6,814,674 B2 * 11/2004 Clausen ..... A63B 53/0466 473/342
6,857,973 B2 * 2/2005 Wieland ..... A63B 53/047 473/342
6,860,819 B2 * 3/2005 Gilbert ..... A63B 53/04 473/291
6,872,153 B2 3/2005 Gilbert et al.
6,923,734 B2 8/2005 Meyer
7,014,568 B2 3/2006 Pelz
7,037,213 B2 5/2006 Otoguro
7,083,530 B2 8/2006 Wahl et al.
7,131,913 B2 * 11/2006 Iwata ..... A63B 53/04 473/350
7,137,903 B2 * 11/2006 Best ..... A63B 53/047 473/290
7,153,219 B2 * 12/2006 Reed ..... A63B 53/047 473/290
7,186,187 B2 * 3/2007 Gilbert ..... A63B 53/047 473/290
7,207,900 B2 4/2007 Nicollette et al.
7,244,188 B2 * 7/2007 Best ..... A63B 53/047 473/291
7,294,065 B2 11/2007 Liang et al.
7,338,387 B2 3/2008 Nycum et al.
7,396,295 B1 * 7/2008 Frame ..... A63B 53/0487 473/337
7,513,835 B2 * 4/2009 Belmont ..... A63B 53/0466 473/328
7,575,523 B2 8/2009 Yokota
7,588,502 B2 9/2009 Nishino
7,670,236 B2 3/2010 Kajita
7,803,064 B2 9/2010 Roach et al.
7,988,564 B2 * 8/2011 Jertson ..... A63B 53/047 473/290
8,033,931 B2 10/2011 Wahl et al.
8,083,610 B2 12/2011 Roberts et al.
8,088,023 B2 1/2012 Kubota
8,133,129 B2 3/2012 Boyd et al.
8,187,120 B2 5/2012 Gilbert et al.
8,257,198 B2 9/2012 Gilbert et al.
8,409,028 B2 4/2013 Wahl et al.
8,491,405 B2 7/2013 Jorgensen et al.
8,579,729 B2 * 11/2013 Nelson ..... A63B 53/047 473/350

(56) References Cited

U.S. PATENT DOCUMENTS

| | | | |
|---|---|---|---|
| 2004/0127300 | A1 | 7/2004 | Roesgen et al. |
| 2009/0176596 | A1 | 7/2009 | Kobayashi |
| 2011/0165961 | A1 | 7/2011 | Cackett et al. |
| 2012/0064997 | A1 | 3/2012 | Sato |
| 2012/0238375 | A1 | 9/2012 | Park et al. |
| 2013/0310191 | A1 | 11/2013 | Cackett et al. |
| 2013/0324276 | A1 | 12/2013 | Stites et al. |
| 2015/0005099 | A1 | 1/2015 | Hettinger et al. |

FOREIGN PATENT DOCUMENTS

| | | | | |
|---|---|---|---|---|
| JP | 02265579 | A | * | 10/1990 |
| JP | 5123427 | | | 5/1993 |
| JP | 6296717 | | | 10/1994 |
| JP | 8112380 | | | 5/1996 |
| JP | 8257173 | | | 10/1996 |
| JP | 9285571 | | | 11/1997 |
| JP | 09285571 | A | * | 11/1997 |
| JP | 10192459 | | | 7/1998 |
| JP | 10258143 | | | 9/1998 |
| JP | H10-0244025 | | | 9/1998 |
| JP | 10277187 | | | 10/1998 |
| JP | 10295861 | | | 11/1998 |
| JP | 11033145 | | | 2/1999 |
| JP | 11146934 | | | 6/1999 |
| JP | 11146934 | A | * | 6/1999 |
| JP | 11155985 | | | 6/1999 |
| JP | 2000116823 | | | 4/2000 |
| JP | 2000167089 | | | 6/2000 |
| JP | 2000300701 | | | 10/2000 |
| JP | 200137929 | | | 2/2001 |
| JP | 2001104520 | | | 4/2001 |
| JP | 2001259094 | | | 9/2001 |
| JP | 2001314535 | | | 11/2001 |
| JP | 2002119627 | | | 4/2002 |
| JP | 2002143356 | | | 5/2002 |
| JP | 2002253712 | | | 9/2002 |
| JP | 200347678 | | | 2/2003 |
| JP | 2003102875 | | | 4/2003 |
| JP | 2003135632 | | | 5/2003 |
| JP | 2003169870 | | | 6/2003 |
| JP | 2003180889 | | | 7/2003 |
| JP | 2003190340 | | | 7/2003 |
| JP | 2003236025 | | | 8/2003 |
| JP | 2003265653 | | | 9/2003 |
| JP | 2003299755 | | | 10/2003 |
| JP | 2004135991 | | | 5/2004 |
| JP | 2004141451 | | | 5/2004 |
| JP | 2004159680 | | | 6/2004 |
| JP | 2005185652 | | | 7/2005 |
| JP | 2005278757 | | | 10/2005 |
| JP | 2005319122 | | | 11/2005 |
| JP | 2006000139 | | | 1/2006 |
| JP | 200681862 | | | 3/2006 |
| JP | 2006122371 | | | 5/2006 |
| JP | 2006149478 | | | 6/2006 |
| JP | 2006223460 | | | 8/2006 |
| JP | 2006223461 | | | 8/2006 |
| JP | 2006239154 | | | 9/2006 |
| JP | 2007319687 | | | 12/2007 |
| JP | 200966417 | | | 4/2009 |
| JP | 2009261930 | | | 11/2009 |
| WO | WO 2007044220 | | | 4/2007 |

* cited by examiner

WEDGE TYPE GOLF CLUB HEAD

CROSS-REFERENCE TO RELATED APPLICATION

The present application is a Continuation of co-pending U.S. patent application Ser. No. 14/318,781, filed on Jun. 30, 2014, which is a Continuation-In-Part of U.S. patent application Ser. No. 14/071,343, filed Nov. 4, 2013, now U.S. Pat. No. 9,211,450, which is a Continuation of U.S. patent application Ser. No. 12/957,562, filed on Dec. 1, 2010, now U.S. Pat. No. 8,579,729, which is a Continuation-In-Part of U.S. patent application Ser. No. 12/832,488, filed on Jul. 8, 2010, now U.S. Pat. No. 8,491,414, which is a Continuation-In-Part of U.S. patent application Ser. No. 12/474,316, filed on May 29, 2009, now U.S. Pat. No. 8,187,120; the disclosure of which are all incorporated by reference in their entirety.

FIELD OF THE INVENTION

The present invention relates generally to a wedge type golf club head with a lower center of gravity in the lower lofted clubs and a higher center of gravity in the higher lofted clubs. More specifically, the present invention relates to a wedge type golf club head that has a high loft and a low center of gravity allowing for increased back spin, increased launch angle, and increased ball speed in lower irons to create a smoother transition between iron type golf club heads; while reversing the trend to elevate the center of gravity location in higher lofted clubs to promote more versatility and performance. In addition to the above, the present invention also discloses a golf club head with an increased topline thickness that varies with the loft of the golf club head.

BACKGROUND OF THE INVENTION

Golf clubs, combined with golf balls, have generally been considered to be the most essential equipment in the game of golf. Progressing in parallel with the development of the game of golf, significant developments have occurred within the golf equipment industry. Golf clubs, especially wedge type golf clubs, have also developed simultaneously with all other types of golf equipment to accommodate for the needs of the golfer to hit their shots more accurately and with more control.

Wedge type golf clubs, more commonly known as wedges, are a particular type of golf club that generally has a higher loft angle. These higher lofted wedges tend to be precision instruments that allow a golfer to dial in short range golf shots with improved trajectory, improved accuracy, and improved control. This increased loft angle in wedges generally yield a golf shot with a higher trajectory because of the impact surface with the golf ball is not perpendicular to the trajectory of the club head; but rather, the golf ball interacts with the wedge at an inclination closely resembling the actual loft angle of the wedge itself. This inclination generally causes the golf ball to move up along the inclination of the wedge when struck by the wedge type golf club head, creating a backward rotation of the golf ball as it leaves the wedge club face. This backwards rotation of the golf ball is generally known as "backspin" within the golf industry; and it is desirable in helping improve trajectory, accuracy, and control of a wedge type golf shot.

Backspin helps improve trajectory, accuracy, and control of a golf shot by giving the golf ball a gyroscopic effect, which stabilizes ball flight, hence increasing accuracy. Moreover, backspin also serves to increase control of a golf shot as backspin minimizes the roll of a golf ball after landing, creating a more predictable golf shot even after it lands on the ground.

A number of methods are generally known in the golf club art to increase backspin. For example, one method to generate increased backspin may be increasing the coefficient of friction of the wedge club face. U.S. Pat. No. 5,804,272 to Schrader titled Backspin Sticker ('272 patent) generally discloses a combination of a backspin sticker and a golf club having an angled surface for increasing the backspin of a golf ball when it hits the putting surface. More specifically, the '272 patent discloses a sticker, shaped to conform to a hitting area on the hitting surface, the sticker having a front surface with a coating of silicon carbide grain affixed with a synthetic resin and an adhering region having a clear, pressure sensitive adhesive applied thereon.

U.S. Pat. Pub. No. US 2004/0127300 to Roesgen et al. titled Golf Clubhead ('300 patent publication) is another example of a methodology used to increase backspin of a wedge type golf club by increasing coefficient of friction of the wedge club face. The '300 patent publication generally discloses a golf clubhead made from metal, having a strike face which has a loft angle $\alpha$ of greater than 45°, the strike face having a plurality of parallel grooves, where the strike face has a surface roughness Ra of less than 0.25 micrometer, and a Vickers hardness of the strike face greater than 5 GigaPascal.

Although the surface treatments discussed above may be effective in increasing the backspin of a golf ball, surface treatments often suffer from gradual wear and tear, making them less optimal. In order to address that issue, U.S. Pat. No. 7,014,568 to Pelz for a Golf Club ('568 patent) discloses a wedge face groove configuration that may also be beneficial in increasing backspin. More specifically, the '568 patent discloses a wedge hitting surface may take the form of an insert that includes a series of grooves, the design of which is varied from club to club to provide increasing friction with loft. Even more specifically, the wedges may utilize a club face of a constant surface roughness so that, regardless of club loft, the surface friction is kept constant and only the grooves of each club are varied to provide the changing impact friction required to provide constant spin rate.

U.S. Pat. No. 5,437,088 to Igarashi for a Method of Making a Golf Club that Provides Enhanced Backspin and Reduced Sidespin ('088 patent) also discloses a groove configuration that achieves increased backspin of a golf ball. More specifically, the '088 patent discloses an improved golf club wherein the surface of the face of the club is substantially flat, which is achieved by surfacing (milling) the club face, and wherein the edges of scoring lines (grooves) are made relatively sharp as a result of the surfacing operation. The sharp groove edges (and milling lines) of the present invention produce enhanced backspin and reduced sidespin when a golf ball is struck, which results in a relatively straight golf ball flight path, notwithstanding a glancing club impact angle.

As it can be seen from above, numerous attempts have been made to improve the backspin of a golf ball, especially when being hit with a wedge type golf club. However, the current methodology of utilizing either a surface treatment or groove configurations does not maximize the inherent potential of a wedge type golf club. More specifically, the current methodology does not take in to consideration the potential backspin and out going ball speed benefits that can be achieved by a wedge type golf club if the center of gravity (CG) location is shifted towards an alternate location that maximizes the efficiency of energy transfer between the wedge type golf club head and a golf ball.

FIG. 1, shows an exemplary wedge 100 in accordance with a prior art wedges wherein the location of the center of gravity (CG) 102 is at a distance d1 away from the ground 106. As shown FIG. 1, distance d1 denotes the location of the CG 102 of wedge 100 being a significant distance away from the ground 106. Distance d1, as shown in this exemplary prior art embodiment may generally be greater than 20 mm; however prior art wedges could have distance d1 be 21 mm, 22 mm, 23 mm, or any CG 102 location distance that is relatively high within a wedge without departing from exemplary prior art wedge 100.

Having a CG 102 location that is so high above ground 106 may generally be undesirable as it does not maximize the efficiency of energy transfer between the wedge type golf club head 100 and a golf ball. In order to maximize the efficiency of energy transfer between the wedge type golf club head 100 and a golf ball, it is generally desirable to have the CG 102 in closer proximity to the ground 106, and more preferably along an axis of impact perpendicular to the hitting surface that runs through the CG of the golf club and the center of the golf ball.

In addition to the increased backspin benefits that can be achieved by maximizing the CG location of a wedge type golf club, maximizing the CG location will also allow for increased performance characteristics such as increased ball speed and increased launch angle that correlates into increased trajectory, increased accuracy, and increased control. Increased ball speed will yield increased shot distance. If an increased spin is desired while keeping shot distance constant, the wedge loft will have to be increased, a characteristic which will mitigate the ballspeed increase while adding even more backspin to the ball, yielding even more overall stopping power or accuracy.

With respect to the ability of the golf club head to have an increased topline thickness that varies with the loft of the golf club head to improve the performance of the wedge type golf club head, the prior art, U.S. Pat. No. 5,547,426 to Wood discloses a golf club head using progressively sized heads having slots of selected depths in the back of the golf club head. These golf club heads may have a progressive top edge thickness so that all top edge appear to have the same width in use, but it makes no attempt to utilize and adjust this variation in topline thickness to improve the moment of inertia of the golf club head.

Hence, it can be seen that there is a need in the field for a golf club that is capable of improving the backspin characteristics without the need to either adjust the grooves or provide surface treatment to the wedge type club face. More specifically, there is a need in the field for a wedge type golf club that is capable of optimizing the performance characteristics of a golf shot such as backspin, ball speed, and launch angle by utilizing strategically placed CG locations within the wedge type golf club. The CG optimized wedge type golf club head that has improved performance characteristics may then be used in conjunction with a wedge type golf club head with various grooves or surface treatments to further optimize the backspin characteristics of a wedge type golf club head.

BRIEF SUMMARY OF THE INVENTION

In one aspect of the present invention is a wedge type golf club head comprising of a hosel, a body portion attached to the hosel at a loft angle, wherein the body further comprises a hitting surface and a rear portion, and a sole at a bottom of the body connecting the hitting surface to the rear portion. The rear portion further comprises of a thickened topline portion having a first thickness, a thinned central portion having a second thickness, and a hollow cavity located near the sole, wherein the wedge type golf club head has a center of gravity location that is between about 16 mm and about 20 mm away from the ground.

In another aspect of the present invention is a wedge type golf club head comprising of a hosel, a body attached to the hosel at a loft angle, wherein the body further comprises a hitting surface and a rear portion, and a sole at a bottom of the body, connecting the hitting surface to the rear portion. The rear portion further comprises a thickened topline portion having a first thickness and a thinned central portion having a second thickness, and a hollow cavity located near the sole, wherein the hitting surface and the rear portion form an angle $\theta$ is between about 3° and about 8°.

In a further aspect of the present invention the golf club head could even have a Center of Gravity location that is between about 16.5 mm to about 20.5 mm above the ground, more preferably between about 17.5 mm to about 21.5 mm, and more preferably between about 18.5 mm to about 22.5 mm.

In a further aspect of the present invention is a plurality of two or more golf club head comprising of a first golf club head having a first loft angle and a first CG-y location, a second golf club head having a second loft angle and a second CG-y location, wherein both the first loft angle and the second loft angles are greater than about 45 degrees and wherein said first loft angle is smaller than said second loft angle, wherein the first CG-y location is lower to or equal to said second CG-y location, wherein the CG-y location is defined as a distance of a CG location along an y-axis from a ground plane.

These and other features, aspects and advantages of the present invention will become better understood with references to the following drawings, description and claims.

BRIEF DESCRIPTION OF DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description is the best currently contemplated modes of carrying out the invention. The description is not to be taken in a limiting sense, but is made merely for the purpose of illustrating the general principles of the invention, since the scope of the invention is best defined by the appended claims.

Various inventive features described below can each be used independently of one another or in combination with other features. However, any single inventive feature may not address any or all of the problems discussed above or may only address one of the problems discussed above. Further, one or more of the problems discussed above may not be fully addressed by any of the features described below.

Figure 2:
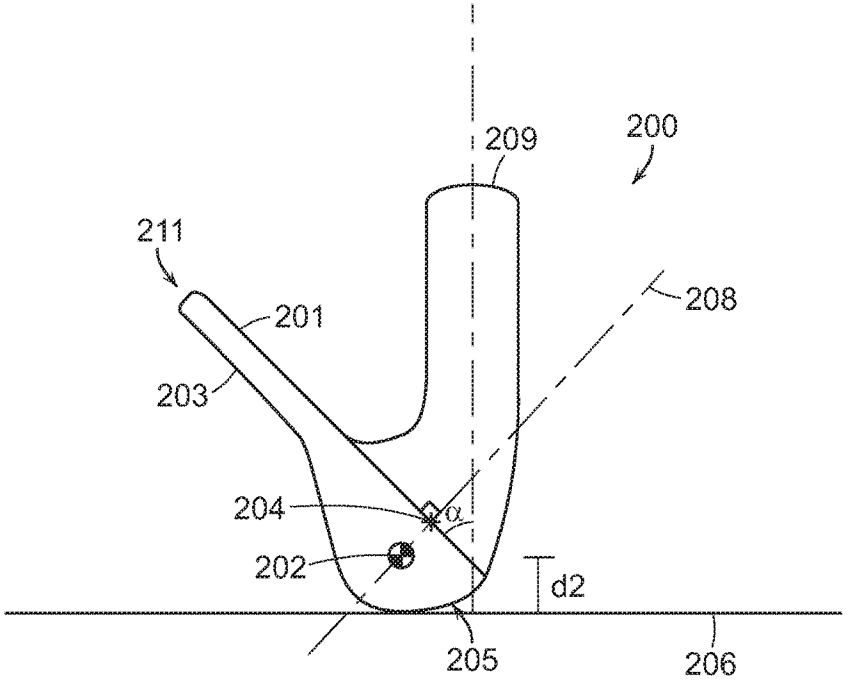
FIG. 2 shows a side view of a wedge type golf club head in accordance with an exemplary embodiment of the present invention.

FIG. 2 shows a side view of a wedge type golf club head 200 in accordance with an exemplary embodiment of the present invention having a specific center of gravity (CG) 202 location substantially along a neutral axis 208. Wedge type golf club head 200, as shown in the current exemplary embodiment, may contain a hosel 209 and a body 211 being attached to the hosel 209. The body 211 may be further comprised of a hitting surface 201 and a rear portion 203 connected by a sole 205 portion at the bottom of the wedge type golf club head 200. The sole 205, as shown in the current exemplary embodiment, generally has at least a portion of the sole 205 resting on the ground 206 at an angle formed by the sole 205 profile of the wedge type golf club head 200 when the golf club head is placed at address. The body 211, and more particularly the hitting surface 211, may be connected to the hosel at a loft angle $\alpha$ to create a lofted wedge type golf club head 200. The wedge type golf club head 200, as shown in the current exemplary embodiment, may have a neutral axis 208 that is perpendicular to the hitting surface 201, while passing through an impact point 204 on the hitting surface 201. The neutral axis 208 may generally be used to help determine the location of a center of gravity (CG) 202 of the wedge type golf club head 200, wherein the CG 202 location may generally be provided substantially along the neutral axis 208 behind the hitting surface 201. Finally, FIG. 2 shows the CG 202 being generally at a distance d2 from the ground 206 in accordance with the present invention.

Neutral axis 208, as shown in the current exemplary embodiment, may generally be an arbitrary line that is ninety degrees and perpendicular to the hitting surface 201. In addition to being perpendicular to the hitting surface 201, this neutral axis 208 may also generally pass through the hitting surface 201 at an impact point 204 in accordance with the present invention. The neutral axis 208 generally determines the path of travel of a golf ball after impacting the wedge type golf club head 200, and the neutral axis is further defined by the CG 202 location of the wedge type golf club head as the neutral axis 208 also passes through the CG 202 location.

Figure 1:
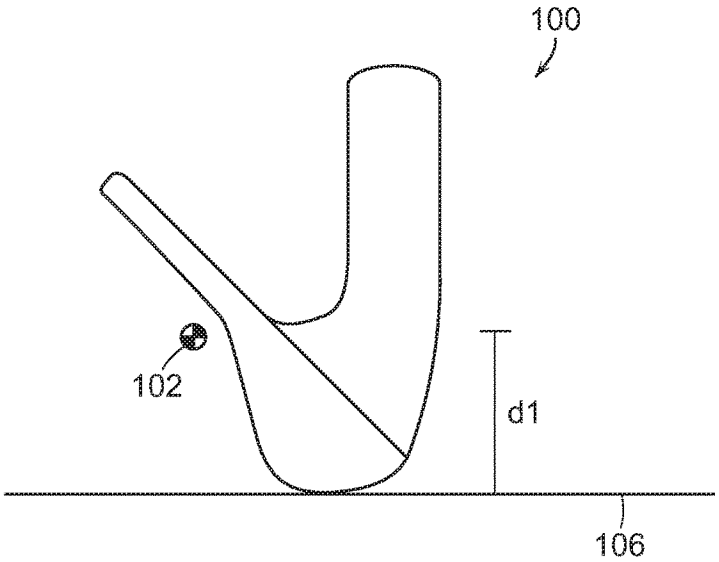
FIG. 1 (Prior Art)
FIG. 1 shows a side view of a prior art wedge type golf club head.

The wedge type golf club head 200, as shown in the current exemplary embodiment, may generally have a CG 202 location significantly lower than that of a prior art wedge type golf club head 100. (See FIG. 1). To put it in another way, the distance d2, as shown in FIG. 2 may generally be lesser than the distance d1 as shown in FIG. 1. More specifically, wedge type golf club head 200, as shown in the current exemplary embodiment, has the CG 202 location substantially along the neutral axis 208 instead of at an arbitrary location substantially above the neutral axis shown in FIG. 1. Even more specifically, FIG. 2 shows that CG 202 may be located directly on the neutral axis 208 and behind the hitting surface 201 and closer to the average impact point for most golfers with a wedge type golf club.

Having a CG 202 location directly on the neutral axis 208 may generally help improve the performance characteristics of a wedge type golf club head 200 by improving energy transfer efficiency and generate more momentum along the impact direction. This improved energy transfer generates more momentum and may directly improve the backspin, the ball speed, and the launch angle of a golf ball that is struck by the wedge type golf club head 200 irrespective of the grooves on the hitting surface 201 of the wedge type golf club head 200. It should be noted that significant improvements in the performance characteristics may be achieved just by having the CG 202 substantially along the neutral axis 208 and perfect alignment is not necessary. To achieve the significantly improved performance characteristic, the CG 202 location may be any location behind hitting face 201 and preferably at a location substantially along the neutral axis 208 in accordance with an embodiment of the present invention.

Impact point 204 may generally depict the point where a golf ball will come into contact with the wedge type golf club head 200. To put in another way, impact point may generally be the location where most golfers will hit a golf ball when utilizing a wedge type golf club head. Impact point 204, as shown in the current exemplary embodiment, may generally be 10 mm to 20 mm from ground 206; however, impact point 204 may be more preferably 12 mm to 18 mm from ground 206 or even more preferably from 14 mm to 16 mm from ground 206, and most preferably 15 mm from ground 206 all without departing from the scope and content of the present invention. The impact point 204, may help define the upper limit of the CG 202 location that is a distance d2 away from ground 206. Distance d2, as shown in the current exemplary embodiment may generally be less than 20 mm from ground 206, however, CG 202 location may more preferably be less than 18 mm from ground 206 or even more preferably less than 16 mm from ground 206, and most preferably less than 15 mm from ground 206 all without departing from the scope and content of the present invention.

Loft angle $\alpha$, as shown in the current exemplary embodiment, may generally be directed towards a higher lofted club such as a wedge type golf club head 200. Wedge type golf club head 200, may generally have a loft angle $\alpha$ greater than 45 degrees; however loft angle $\alpha$ may be less then 45 degrees, or even exactly at 45 degrees all without departing from the scope and content of the present invention so long as the wedge type golf club head 200 could benefit from the enhanced performance that is achievable from the optimized CG 202 location associated with a wedge type golf club head 200.

Figure 4:
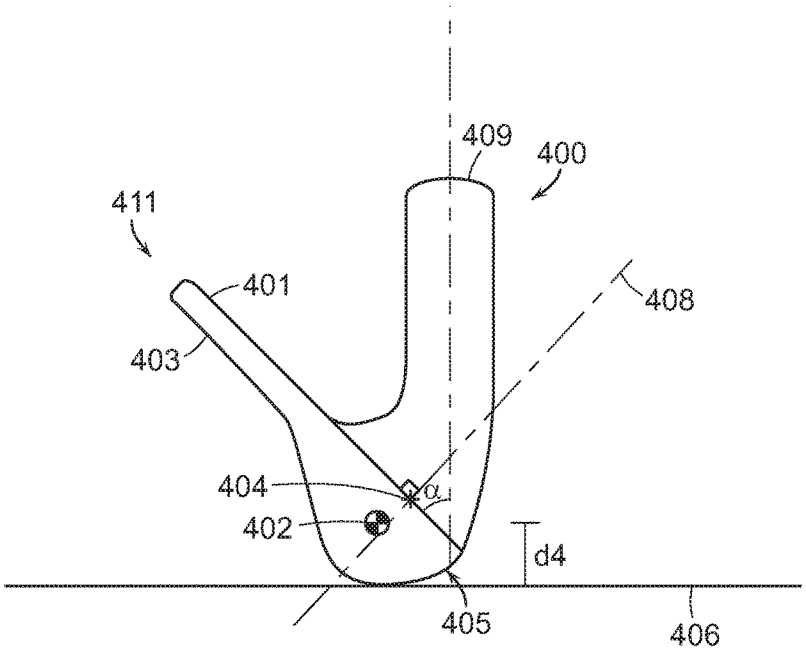
FIG. 4 shows a side view of a wedge type golf club head in accordance with a further alternative embodiment of the present invention.
Figure 3:
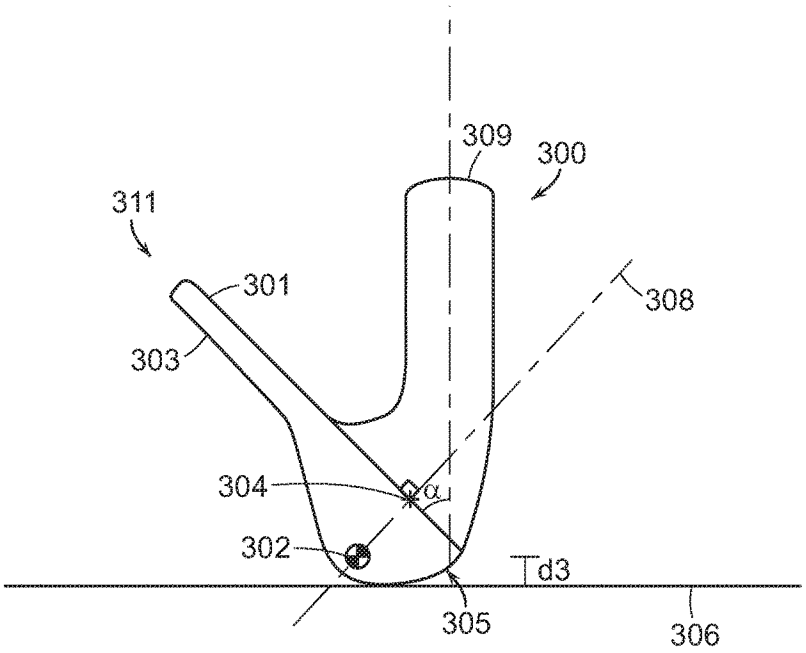
FIG. 3 shows a side view of a wedge type golf club head in accordance with an alternative embodiment of the present invention.

FIG. 3 shows an alternative embodiment of the present invention wherein wedge type golf club head 300, despite also having its CG 302 location substantially along the neutral axis 308, may have a distance d3 from the ground 306 that is significantly less than distance d2. Under this alternative embodiment shown in FIG. 3, wedge type golf club head may also have significantly improved performance characteristics such as backspin, ball speed, and launch angle because CG 302 is located directly on the neutral axis 308. Distance d3, as shown in the current exemplary embodiment may also generally be lower than the impact point 304, and may generally be less than 20 mm from ground 206, however, CG 302 location may more preferably be less than 18 mm from ground 306 or even more preferably less than 16 mm from ground 306, and most preferably less than 15 mm from ground 306 all without departing from the scope and content of the present invention. Wedge type golf club head 300, due to the CG 302 location, may generally improved energy transfer that generate more momentum may directly improve the backspin, the ball speed, and the launch angle of a golf ball FIG. 4 shows an even further alternative embodiment of the present invention wherein the wedge type golf club head 400 has a CG 402 location that is substantially along the neutral axis 408, but not directly on the neutral axis 408. Under this alternative embodiment shown in FIG. 4, the CG 402 may have a location that is slightly above the neutral axis 408, at a distance d4 away from ground 406, while still remaining substantially along the neutral axis 208. CG 402 location, although not directly on the neutral axis 408, is still capable of increasing the performance characteristics that generate more momentum and may directly improve the backspin, the ball speed, and the launch angle of a golf ball especially when compared to a prior art wedge 100, with its CG 102 location at a much higher location. (Shown in FIG. 1).

Figure 5:
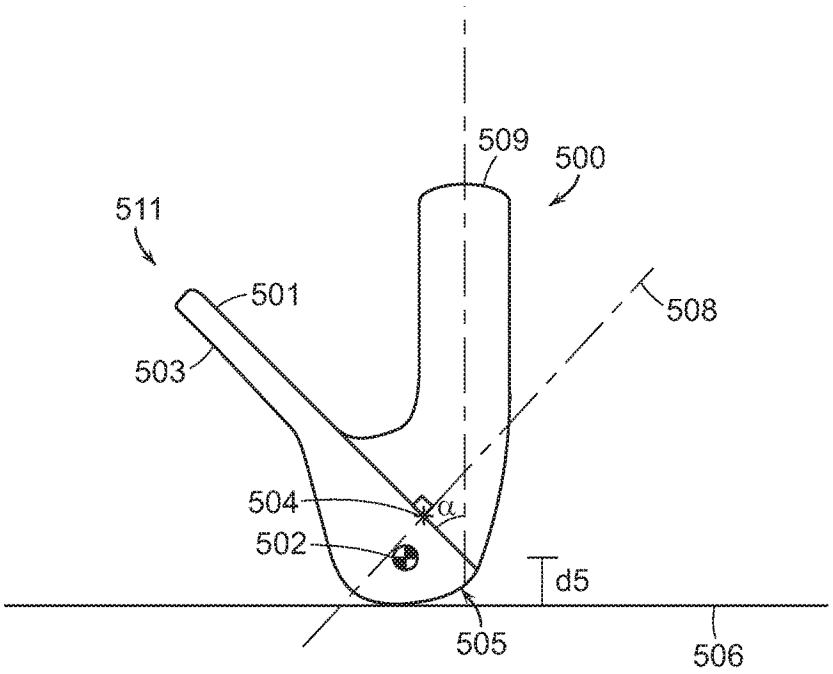
FIG. 5 shows a side view of a wedge type golf club head in accordance with a further alternative embodiment of the present invention.

FIG. 5 shows an even further alternative embodiment of the present invention wherein the wedge type golf club head 500 has a CG 502 location that is substantially along the neutral axis 508, but also not directly on the neutral axis 508. Under this alternative embodiment shown in FIG. 5, the CG 502 may have a location that is slightly below the neutral axis 508, at a distance d5 away from ground 506. CG 502 location, although not directly on the neutral axis 508, is still capable of increasing the performance characteristics that generates more momentum which may directly improve the backspin, the ball speed, and the launch angle of a golf ball especially when compared to a prior art wedge 100, with its CG 102 location at a much higher location. (Shown in FIG. 1)

Figure 6:
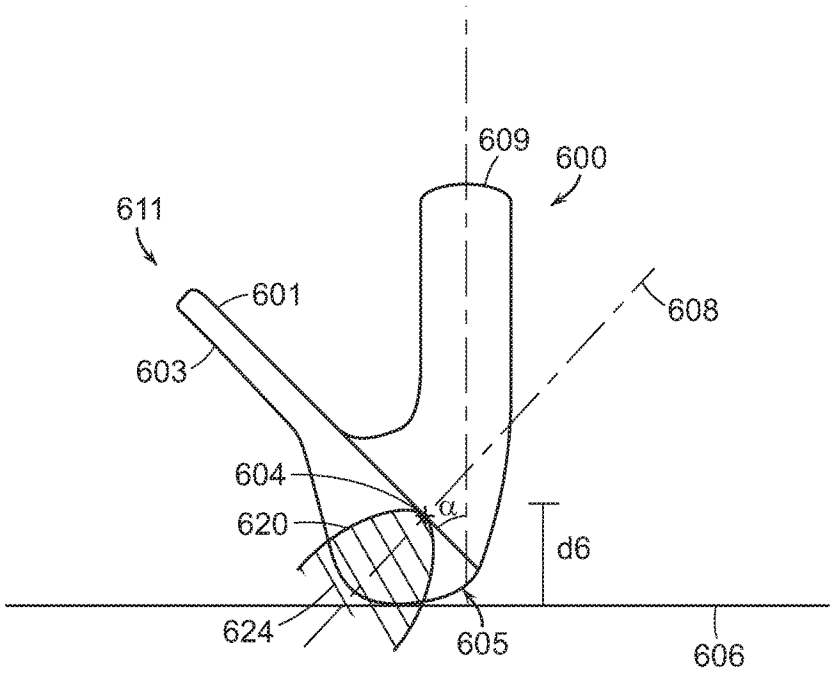
FIG. 6 shows a side view of a wedge type golf club head in accordance with the current invention wherein the range of the center of gravity CG location is shown.

As it can be seen from FIGS. 2-5, the CG may be located at various locations within wedge type golf club head, so long as it is substantially along the neutral axis, all in accordance with the scope and content of the present invention. FIG. 6 may generally characterize the boundaries of the potential CG location within a wedge type golf club head 600 that further clarifies the "substantially along" terminology in accordance with the present invention. FIG. 6 may show a wedge type golf club head 600 highlighting a parabolic region 620 that defines the boundaries of the potential CG location of a wedge type golf club head 600 in accordance with an exemplary embodiment of the present invention. Parabolic region 620 may have its vertex located at the impact point 604 and the parabolic region 620 may generally be bisected by the neutral axis 608 defining its location within the wedge type golf club head 600. Parabolic region 620 may generally have an open direction 624 directed towards the rear portion 603 of the body 611 while being slightly slanted towards the sole 605. Parabolic region 620 may generally define the boundaries for the location of a CG within wedge type golf club head 600, as the area encompassed by the parabolic region 620 may generally be considered to be "substantially along" the neutral axis 608 without departing from the scope and content of the present invention.

FIG. 6 may so show a distance d6, depicting the upper limit of the height of a potential CG location in accordance with the present invention. D6, as shown in the current exemplary embodiment may generally be the same height as impact point 604, which may generally be 10 mm to 20 mm from ground 606; however, impact point 604 may be more preferably 12 mm to 18 mm from ground 606 or even more preferably from 14 mm to 16 mm from ground 606, and most preferably 15 mm from ground 606.

The size of the parabolic region 620 may generally determine the CG locations that may be substantially along the neutral axis 608. More specifically, parabolic region 620, may generally define a region that will ensure that the CG location be within 7 mm of neutral axis 608; more preferably no greater than 5 mm; and most preferably no greater than 3 mm all without departing from the scope and content of the present invention. The perimeter of the parabolic region 620 may generally depict the region that will encompass the CG locations that will help achieve higher backspin, higher ball speed, and higher launch angle of a golf ball in accordance with the exemplary embodiment of the present invention.

The parabolic region 620 as shown in FIG. 6 may generally allow the CG to be located within a region that will improve performance to accommodate for different swing conditions generally associated with a golf swing. In order to optimize the swing conditions, it may generally be desirable to have the CG location be substantially along the neutral axis 608, which is based on the impact location 604. However, because different swings may generally create a different neutral axis 608 the optimal CG location will often vary with different swing characteristics. Because of the above mentioned swing variation, which can sometimes occur intentionally when a player de-lofts a club, the parabolic region 620 that defines the boundaries of the CG location will ensure the wedge type golf club head 600 will achieve optimal performance irrespective of the individual swings.

Figure 7:
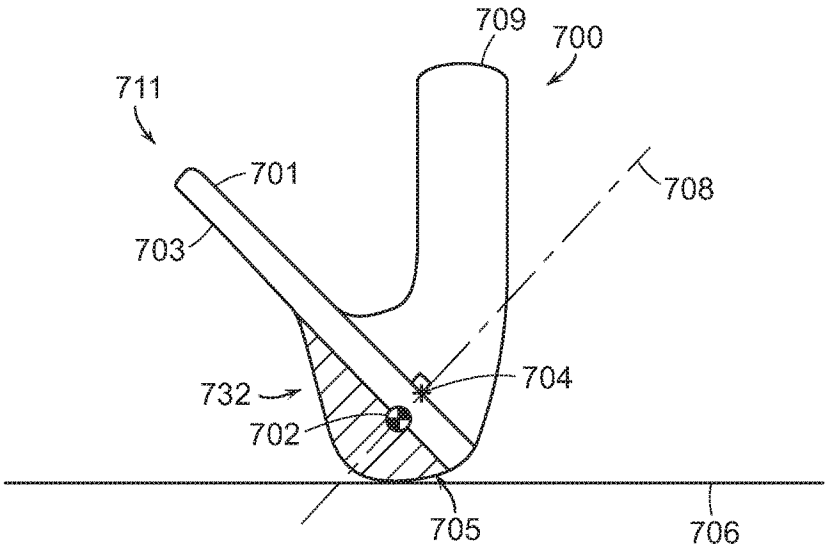
FIG. 7 shows a side view of an embodiment of the present invention showing the sole portion being made out of a weighted material.

FIG. 7 may serve to show the physical composition of a wedge type golf club head 700 that can be used to achieve a lower CG 702 location in accordance with the exemplary embodiments of the present invention. In order to achieve a lower CG 702 location, wedge type golf club head 700 may generally have a sole 705 that is further comprising of a weighted portion 732; wherein the weighted portion 732 may be comprised of a material that is denser than that of the remainder of the wedge type golf club head 700. The increased density of the weighted portion 732 may generally be used to lower the CG 702 of the wedge type golf club 700 to a location that is significantly lower than that of a prior art wedge 100. (Shown in FIG. 1)

Weighted portion 732, as shown in the current exemplary embodiment, may generally be comprised of a second material having a relatively high density such as tungsten; however, numerous other materials such as tungsten nickel, lead, copper, iridium, or any other material with a high density may all be used without departing from the scope and content of the present invention. The remainder of the wedge type golf club head 700, inversely, may generally be comprised of a standard material that has a lower density than that of the weighted portion 732. Wedge type golf club head 700, may generally be comprised of steel, however, numerous other materials such as aluminum, iron, copper, titanium, or even plastic so long as it has a density lower than that of the weighted portion 732 all without departing from the scope and content of the present invention.

In an exemplary embodiment of the present invention, weighted portion 732 may have a density of about 19300 kg/cubic meters when it is comprised of a material such as tungsten. Alternatively, the remainder of the wedge type golf club head 700 may have a density of about 7800 kg/cubic meters when it is comprised of a material such as steel. This relationship of the density between the weighted portion 732 and the remainder of the wedge type golf club head 700 may generally create a weight ratio that is greater than 2.0, more preferably greater than 2.25, and most preferably greater than 2.5; wherein the weight ratio is defined by the density of the weighted portion 732 over density of the remainder of the wedge type golf club head 700.

Weighted portion 732, as shown in FIG. 7, may replace the entire sole 705 of the wedge type golf club head 700 to create a lower CG 702 location; however, weighted portion 732 may only partially replace the sole 705 to achieve the desirable optimal CG 702 location without departing from the scope and content of the present invention. Wedge type golf club head 700, due to the improved CG 702 location that results from the weighted portion 732 may generally have a lower CG 702 location that improves energy transfer to generate more momentum that improves the backspin, the ball speed, and the launch angle of a golf ball based on the weighted portion 732.

Figure 8:
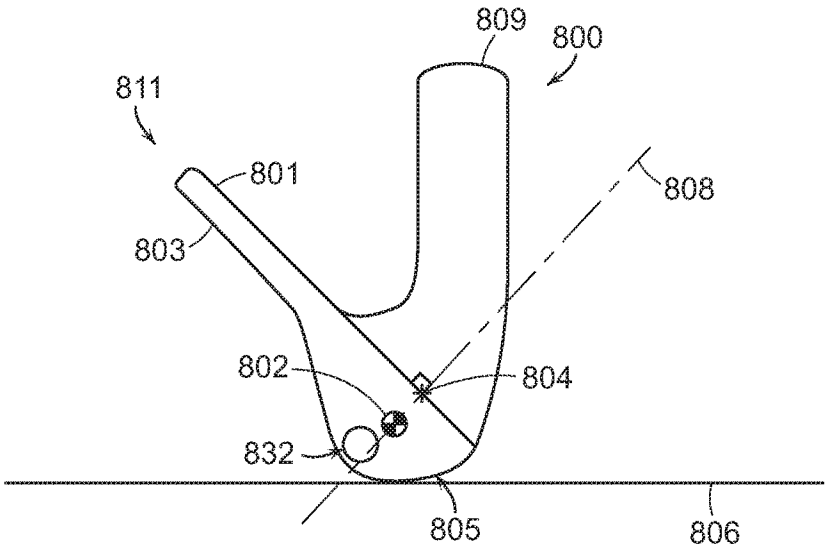
FIG. 8 shows a side view of a further alternative embodiment of the present invention showing the sole portion being partially made out of a weighted material.

FIG. 8 shows a wedge type golf club head 800 in accordance with a further alternative embodiment of the present invention wherein the weighted portion 832 only partially replaces the sole 805 to achieve the lower CG 802 location. FIG. 8 shows a weighted portion 832 resembling the shape of a cylindrical rod passing through the sole 805 of the wedge type golf club head 800 in order to achieve the desirable low CG 802 location. Weighted portion 832, although shown in the current exemplary embodiment as a cylindrical rod, may also be in various other shapes such as a rectangle, a triangular, a octagon, or any other shape that is capable of partially replacing the sole 805 with a material that is of a higher density all without departing from the scope and content of the present invention. It should be noted that in order to incorporate this weighted portion 832 within the golf club head 800, a chamber may be created in the sole 805 of the golf club head 800 to receive the weighted portion 832.

Figure 9:
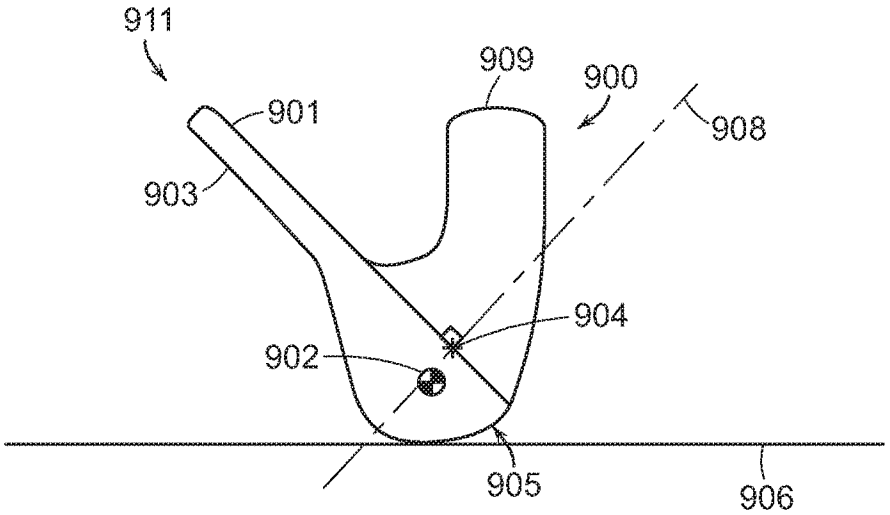
FIG. 9 shows a side view of a further alternative embodiment of the present invention showing a hosel with reduced length.

FIG. 9 shows another wedge type golf club head 900 in accordance with an even further alternative embodiment of the present invention wherein the hosel 909 has been shortened to help lower the CG 902 location within the wedge type golf club head 900. Shortening the hosel 909 removes weight that may generally be located high and away from the sole 905 of the club head, thus allowing the CG 909 to be lowered without the need of a weighted portion. However, it should be noted that the current invention could use a shortened hosel 909 in combination with a weighted portion in the sole to further lower the CG 909 of a wedge type golf club head 900.

Figure 10:
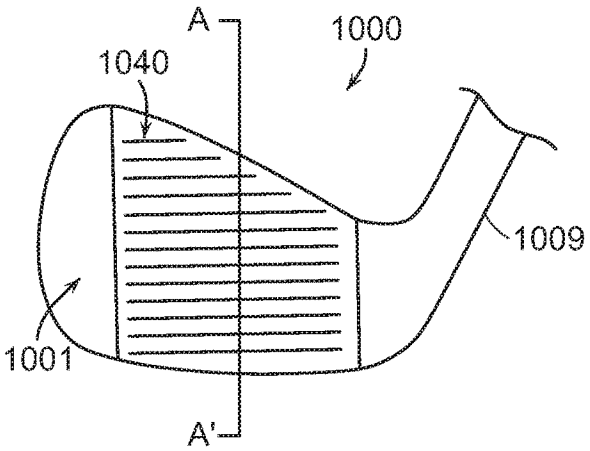
FIG. 10 shows a frontal view of an alternative embodiment of the present invention showing a hitting surface containing grooves.

FIG. 10 shows a front view of a wedge type golf club head 1000 in accordance with a further exemplary embodiment of the present invention showing a hosel 1009 and a plurality of grooves 1040 on the hitting surface 1001 of the wedge type golf club head 1000. Plurality of grooves 1040 may generally be of various shape and sizes and made utilizing various processes as shown in more detail in FIG. 11 without departing from the scope and content of the present invention.

Figure 11:
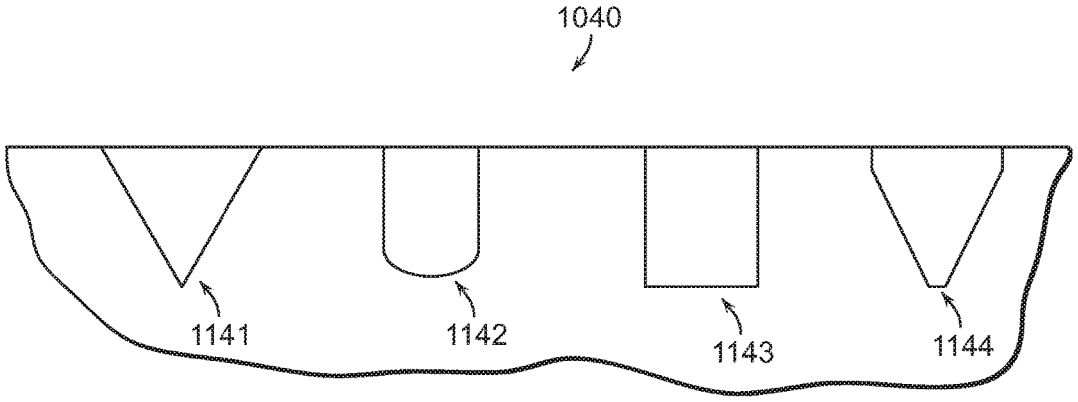
FIG. 11 shows multiple cross-sectional views of groove configurations in accordance with the present invention.

FIG. 11 shows a cross-sectional view of the various embodiments that may be used for the plurality of grooves 1040. Plurality of grooves 1040 may be V-shaped as shown by groove 1141, U-shaped as shown by groove 1142, square shaped as shown by groove 1143, hybrid shaped as shown by groove 1145, or any other groove shape that is capable of improving the coefficient of friction of the wedge type golf club. Moreover, the various groove configurations shown by groove 1141, groove 1142, groove 1143, and groove 1145 may be constructed out of various method such as spin milled, stamped, forged, or any other manufacturing process capable of producing the grooves to help the performance characteristics.

Figure 12:
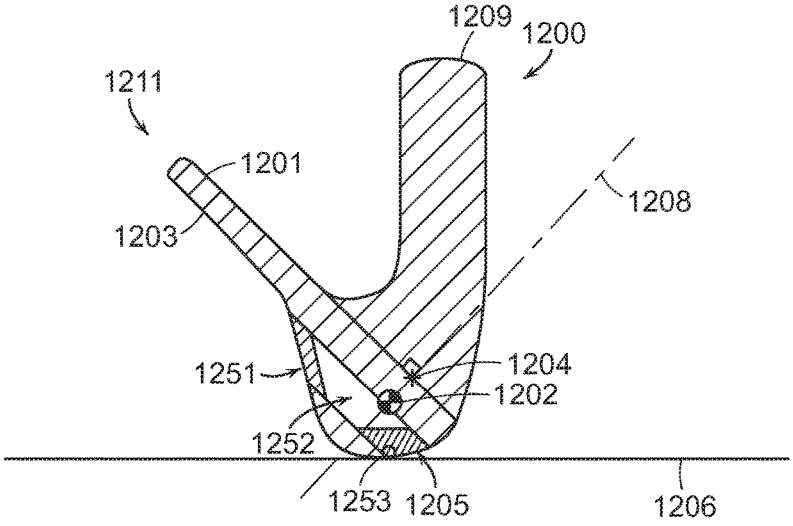
FIG. 12 shows a cross-sectional view of a further alternative embodiment of the present invention showing a different sole profile.

FIG. 12 shows a cross-sectional view of a wedge type golf club head 1200 taken along cross-sectional line A-A' in FIG. 10 to show a further alternative embodiment of the present invention. Wedge type golf club head 1200, as shown in the current alternative embodiment utilizes a partially hollow rear portion 1203 forming a cavity 1252 that may further contain a weighted portion 1253, and covered by a lid 1251. This cavity 1252 portion, which takes away weight from the wedge type golf club head 1200, may serve to help eliminate weight in the rear portion 1203 of the wedge type golf club head 1200 to help lower the CG 1202 location closer to ground 1206. In addition, to the cavity 1252 portion, the weighted portion 1253 that may generally be comprised of a high density material, may help further lower the CG 1202 location closer to ground 1206. The lowered location of CG 1202, once again, may help better align the CG 1202 with the neutral axis 1208, which in turn helps achieve the enhanced performance characteristics such as improve trajectory, accuracy, and control that results from greater backspin. Wedge type golf club head 1200, due to the improved CG 1202 location, may generally improve energy transfer to generate more momentum that directly improves the backspin, the ball speed, and the launch angle of a golf ball.

FIGS. 7, 8, 9, and 12 all show various methodology that may be used to utilize a weighted portion at the sole of a wedge type golf club head to lower the CG location lower than those of a traditional type wedge type golf club head 100 in order to improve the performance characteristics. More specifically, FIGS. 7, 8, 9, and 12 all lower the CG to a location substantially along the neutral axis within the parabolic region 620 (see FIG. 6) in an attempt to improve the backspin and performance characteristics of a wedge type golf club head. It should be noted that FIGS. 7, 8, 9, and 12 only show exemplary methodology that may be used to lower the CG location, and various combinations of the methodology used in FIGS. 7, 8, 9, and 12, or even other methodology not disclosed in FIGS. 7, 8, 9, and 12 may all be used so long as it shifts the CG location within the parabolic region 620 (see FIG. 6) without departing from the scope and content of the present invention.

Finally, it should be noted that because a wedge type golf club head in accordance with the present invention performs so well beyond the actual loft that it is labeled with and measured at, the labeling of the loft angle may need to be adjusted to maintain the same performance numbers previously associated with various wedge type golf club heads. For example, a 55 degree wedge in accordance with the current exemplary invention could very easily achieve performance numbers traditionally associated with a prior art 54 degree wedge without the optimized CG location.

Figure 13:
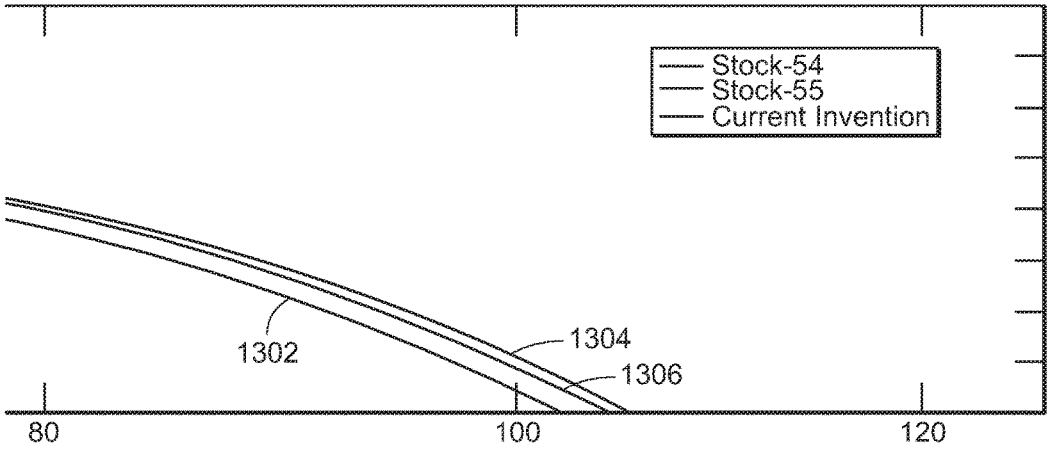
FIG. 13 shows a graphical representation of flight conditions of a golf ball after being struck by various wedge type golf club heads.

FIG. 13 shows a graphical representation of a simulated trajectory for a stock 54 degree wedge in accordance with prior art wedges, a stock 55 degree wedge in accordance with a prior art wedge, and a CG modified 55 degree wedge in accordance with the current invention. Flight path 1302, as shown in FIG. 13, may generally represent a flight trajectory of a stock 54 degree wedge in accordance with the prior art wedge. Flight path 1304, as shown in FIG. 13, may generally represent a flight trajectory of a stock 55 degree wedge in accordance with a prior art wedge. Finally, flight path 1306, as shown in FIG. 13, may generally represent a flight trajectory of a CG modified 55 degree wedge in accordance with the current invention. FIG. 13 may demonstrate through various flight paths that a wedge in accordance with the present invention may be able to achieve increased performance characteristics such as improved backspin, increased ball speed, and increased launch angle similar to those having a lower loft without departing from the scope and content of the present invention.

As it can be seen from FIG. 13, a wedge type golf club head in accordance with the present invention may generally have performance features that are a significant improvement over prior art wedges. Although it may generally be desirable to increase the distance of a golf shot, this improved distance gain in the wedge type golf club head in accordance with the present invention may not be desirable, as accuracy and distance control are more important in a wedge type golf shot. Hence, in order to maintain the same distance, a wedge type golf club head in accordance with the present invention may need to have additional loft to achieve the same distance. This wedge type golf club head with an increased loft may generally be capable of achieving the same distance as a wedge that has a baseline loft value, but do so with an improved trajectory that yields maximum distance control. Improved trajectory, as achieved by a wedge type golf club head in accordance with the present invention, will have a higher launch with more spin yielding a steeper angle of descent allowing more predictability upon landing. "Drop and stop" may generally be a special term of art used by golfers to describe this increased predictability upon landing. This improved predictability is important in a wedge type golf shot, as it is generally a wedge type club is chosen for its accuracy in attacking the pin.

Although FIG. 13 shows that a CG optimized wedge in accordance with the present invention may generally achieve a flight path similar to a prior art wedge that is one degree less lofted; a CG optimized wedge in accordance with the present invention may be able to achieve flight path characteristic similar to a prior wedge that is two degrees less, three degrees less, or any number of degrees less all without departing from the scope and content of the present invention.

Finally, returning to FIG. 2, a wedge type golf club head 200 in accordance with the present invention is shown having the CG 202 located substantially along the neutral axis 208 that may generally help improve the performance characteristics of the wedge type golf club head 200; particularly when compared to a prior art wedge type golf club head 100. (See FIG. 1) More specifically, wedge type golf club head 200 may have an improvement in a Performance Ratio of the wedge type golf club head that is greater than 15,000 rpm*mph, more preferably greater than 20,000 rpm*mph, and most preferably greater than 21,000 rpm*mph. Performance Ratio, as defined in the current invention may generally be defined by equation (1) below.

$$\text{Performance Ratio} = \frac{(\text{Launch Angle}) * (\text{Ball Speed}) * (\textit{Backspin})}{\text{Loft}} \quad (1)$$

Described below for comparative purposes, a prior art wedge type golf club head 100 may have a launch angle of about 27.1 degrees, a ball speed of about 86.9 mph, a backspin rate of about 12138 rpm, and a loft of about 54 degrees; yielding a Performance Ratio of approximately 529,349 rpm*mph. Wedge type golf club head 200, in accordance with an exemplary embodiment of the present invention, may generally have a launch angle of about 27.4 degrees, a ball speed of about 88.2 mph, a backspin rate of about 12330 rpm, and a loft of about 54 degrees; yielding a Performance Ratio of approximately 551,808 rpm*mph. The change in Performance Ratio from a prior art wedge type golf club head 100 to wedge type golf club head 200, as shown in the current exemplary embodiment, may be approximately 22,459 rpm*mph signifying an increased of performance characteristic without departing from the scope and content of the present invention.

Figure 14:
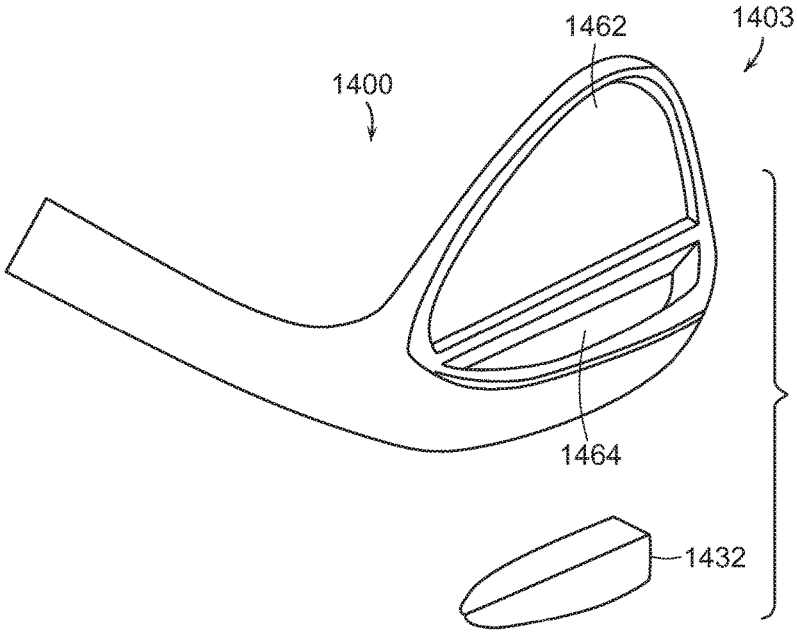
FIG. 14 shows a perspective view of a golf club head in accordance with a further alternative embodiment of the present invention.

FIG. 14 of the accompanying drawings shows a perspective view of a golf club head 1400 in accordance with a further alternative embodiment of the present invention. More specifically, golf club head 1400 shown in FIG. 14 may have two different hollow chambers at the rear portion 1403 of the golf club head 1400 providing a different way to adjust the CG of the golf club head 1400. Even more specifically, the rear portion 1403 of the golf club head 1400 may have an upper chamber 1462 near the upper segment of the golf club head 1400 and a lower chamber 1464 at the bottom segment of the golf club head 1400. The upper chamber 1462 reduces unnecessary weight from the top of golf club head 1400, allowing CG of the golf club head to be lowered. The hollow lower chamber 1464, on the other hand, may generally be filled in with a denser second material to create a weighted portion 1432 that serves to further lower the CG of the golf club head 1400.

Figure 15:
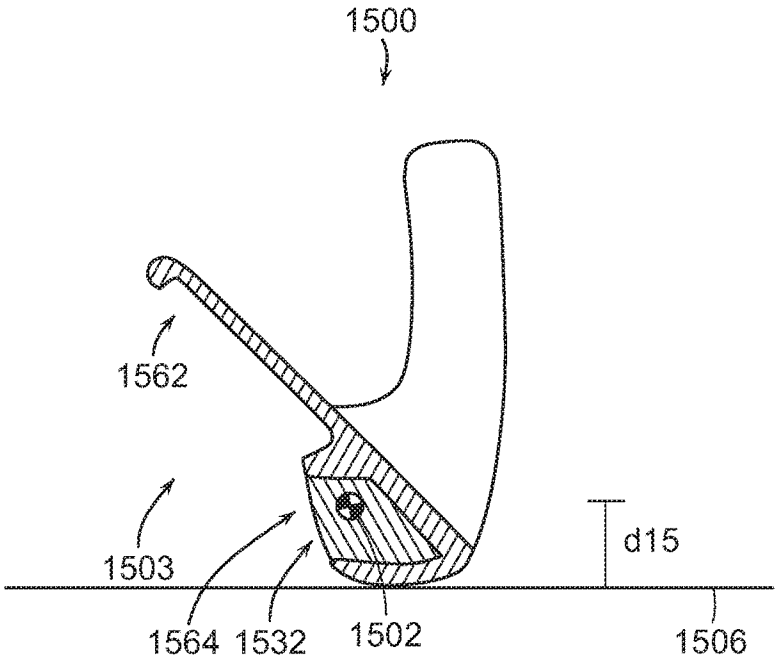
FIG. 15 shows a cross-sectional view of the golf club head shown in FIG. 14.

FIG. 15 of the accompanying drawings shows a cross-sectional view of the golf club head 1400 shown in FIG. 14, taken across the middle of the golf club head 1400. The cross-sectional view of the golf club head 1500 shown in FIG. 15 allows the geometry of the backing portion 1503 to be shown more clearly in conjunction with the location of the CG 1502. In the current exemplary embodiment shown in FIG. 15, the upper chamber 1562 may be hollow while the lower chamber 1564 may be filled with a denser second material to create a weighted portion 1532 to lower the CG 1502 of this golf club head. It should be noted that in this exemplary embodiment, the CG 1502 location may generally be at a distance d15 away from the ground 1506. Distance d15, as shown in this current exemplary embodiment, may generally be greater than about 16 mm and less than about 20 mm, more preferably greater than about 17 mm and less than about 19 mm, most preferably be about 18 mm. In an alternative embodiment of the present invention, the weighted portion 1532 may take on a different shape or size if the upper chamber 1562 and the lower chamber 1564 take on a different size to further adjust the CG 1502 of the golf club head 1500 without departing from the scope and content of the present invention.

Figure 16:
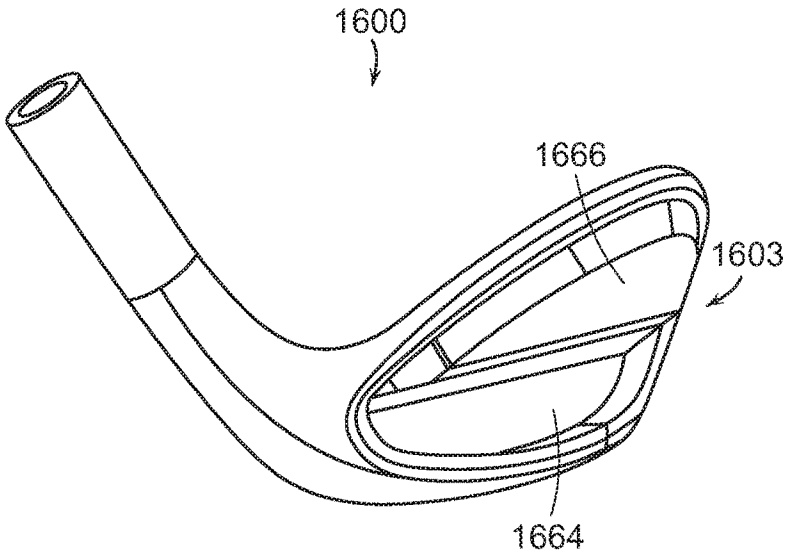
FIG. 16 shows a perspective view of a golf club head in accordance with a further alternative embodiment of the present invention.

FIG. 16 of the accompanying drawings shows a perspective view of a golf club head 1600 in accordance with a further alternative embodiment of the present invention. More specifically, golf club head 1600 may have a thickened upper portion 1666 instead of an upper chamber to help raise the CG of the golf club head 1600. It should be noted that in this alternative embodiment, the lower chamber 1664 may or may not be filled with a secondary material that is denser than the remainder of the golf club head. When the lower chamber 1664 is filled with a denser secondary material, the denser secondary material helps bring the CG location lower. Alternatively, when the lower chamber 1664 is left hollow, the thickened upper portion 1666 helps raise the CG location of the golf club head 1600.

Figure 17:
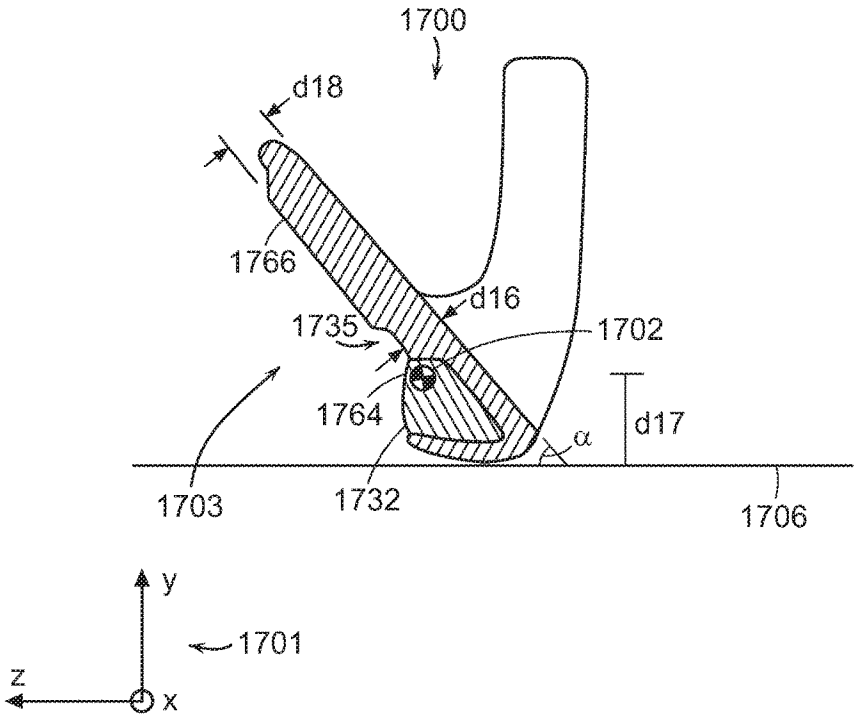
FIG. 17 shows a perspective view of the golf club head shown in FIG. 16.

FIG. 17 of the accompanying drawings shows a cross-sectional view of the golf club head 1600 shown in FIG. 16, taken across the middle of the golf club head 1600. The cross-sectional view of the golf club head 1700 shown in FIG. 17 allows the geometry of the backing portion 1703 to be shown more clearly in conjunction with the location of the CG 1702. The thickened upper portion 1766 of the golf club head 1700 shown in FIG. 17 may generally have a first thickness d18 of greater than about 4.8 mm and less than about 7.1 mm, more preferably greater than about 5.33 mm and less than about 6.6 mm, most preferably about 5.84 mm. This thickened upper portion, as defined in the current exemplary embodiment of the present invention, may generally refer to the thickest portion of the golf club head 1700 that is substantially near the top portion of the golf club head 1700. The cross-sectional view of golf club head 1700 shows a CG 1702 location that results when the lower chamber 1764 is filled with a secondary material that has a higher density to create a weighted portion 1732. It should be noted that if the lower chamber 1764 is left hollow and unfilled, the CG 1702 location may generally be significantly higher. In addition to the above, FIG. 17 of the accompanying drawings also shows a second thickness d16 of the thinned portion 1735 of the golf club head 17, wherein d16 may generally be less than about 6.5 mm, more preferably less than about 6.0 mm, and most preferably less than about 5.8 mm.

In the exemplary embodiment of the golf club head 1700 shown in FIG. 17, the thickened upper portion 1766 may improve the performance of the golf club head 1700 by improving the stability of the golf club head 1700 as it impacts a golf ball. In order to initiate a discussion on the stability of a golf club head 1700, also known as the Moment of Inertia (MOI), a brief explanation of the coordinate system may be necessary. FIG. 17 of the accompanying drawings shows a coordinate system 1701, depicting the y-axis running in a substantially vertical direction, a z-axis running in a horizontal and front to back direction, and a x-axis running in a direction that is stems substantially in a heel to toe direction. The improved stability of the golf club head 1700 discussed here may generally relate to the MOI number about the x-axis of the golf club head 1700 to prevent the golf club head from twisting when the golf club strikes a golf ball at different heights. The MOI of the golf club head 1700 about the x-direction may generally be greater than about 120 $kg*mm^2$, more preferably greater than about 125 $kg*mm^2$, and most preferably greater than about 129 $kg*mm^2$.

In addition to preventing the golf club head from twisting for shots at different heights above the neutral axis, this improved MOI will also improve the performance of the golf club head by preventing a golf ball from sliding up the face of the golf club head 1700 during impact. Because wedge type golf club head may generally have a higher loft angle $\alpha$, a golf ball that contacts the hitting surface of the golf club head 1700 will be more likely to slide up the face of the golf club head 1700 during impact. Having a golf club head 1700 with a higher moment of inertia along the x-axis will allow the golf club head 1700 to remain steady during impact with a golf ball even at different impact heights, minimizing any movement of the golf club head 1700 despite this higher loft angle $\alpha$.

Because the actual first thickness d18 of the thickened upper portion 1766 may be one of the more important factors that affect the MOI of a golf club head 1700 along the x-axis, the exact first thickness d18 of the thickened upper portion 1766 may need to be defined relative to the loft $\alpha$ of the golf club head 1700. Hence, in order to quantify this specific relationship between the thickness d18 and the loft $\alpha$, a "Topline Thickness Ratio" may be defined as shown below by equation (2) below:

$$\textit{Topline}\ \text{Thickness Ratio} = \frac{\text{Loft } (\alpha) \text{ of Golf Club Head}}{\text{First Thickness } (d18) \text{ of Golf Club Head}} \quad (2)$$

"Topline Thickness Ratio", as demonstrated by the current exemplary embodiment of the present invention, may generally be greater than about 6.0 degrees/mm and less than about 9.0 degrees/mm, more preferably greater than about 7.0 degrees/mm and less than about 9.0 degrees/mm, and most preferably greater than about 8.0 degrees/mm and less than about 9.0 degrees/mm. The Topline Thickness Ratio of the current inventive golf club head compared to a prior art golf club head can be found in Table 1 below.

TABLE 1

| | Inventive Golf Club Head | | | | Prior Art Golf Club Head #1 | |
|---|---|---|---|---|---|---|
| Loft | First Thickness (d18) - (mm) | Second Thickness (d16) - (mm) | Thickness Difference (d18/d16) - (mm) | "Topline Thickness Ratio" - (degrees/mm) | Topline Thickness - (mm) | "Topline Thickness Ratio" (degrees/mm) |
| 46 | 5.60 | 5.20 | 0.40 | 8.214 | 5.20 | 8.846 |
| 48 | 5.60 | 5.20 | 0.40 | 8.571 | 5.20 | 9.231 |
| 50 | 6.10 | 5.33 | 0.77 | 8.197 | 5.33 | 9.381 |
| 52 | 6.10 | 5.33 | 0.77 | 8.525 | 5.33 | 9.756 |
| 54 | 6.48 | 5.50 | 0.98 | 8.333 | 5.50 | 9.818 |
| 56 | 6.48 | 5.50 | 0.98 | 8.642 | 5.50 | 10.182 |
| 58 | 7.06 | 5.70 | 1.36 | 8.215 | 5.70 | 10.175 |
| 60 | 7.06 | 5.70 | 1.36 | 8.499 | 5.70 | 10.526 |
| 62 | 7.32 | 5.59 | 1.73 | 8.470 | 5.59 | 11.091 |
| 64 | 7.32 | 5.59 | 1.73 | 8.743 | 5.59 | 11.449 |

Although somewhat related to the Topline Thickness Ratio, it is worth recognizing here that Table 1 also shows the first thickness d18 getting progressively thicker as the loft $\alpha$ of the golf club head 1700 increases. This progressive increase in the first thickness d18 of the thickened upper portion 1766 is important to the performance of the golf club head 1700 because the higher lofted golf club heads would generally require a thicker upper portion 1766 to provide more stability.

In addition to the thickness d18 of the thickened upper portion 1766, table 1 above also shows the second thickness d16 of the thinned portion 1735 of the golf club head 1700. Second thickness d16 may be used to calculate a thickness difference of the rear portion of the golf club head, which provides an alternative methodology to quantify the increasing thickness d16 as it relates to the remainder of the golf club head 1700. A golf club head 1700 in accordance with the current exemplary embodiment of the present invention may generally have a thickness difference of greater than about 0.4 mm, more preferably greater than about 1.0 mm, and most preferably greater than about 1.5 mm. This thickness difference can then be used to calculate a "Thickness Difference Ratio", which provides an alternative way to capture the performance enhancements of the golf club head 1700, defined by equation (3) below:

$$\text{Thickness Difference Ratio} = \frac{\text{Loft } (\alpha) \text{ of Golf Club Head}}{\text{Thickness Difference}} \qquad (2)$$

Thickness Difference Ratio, as it can be seen from above, provides a relationship between the loft of the golf club head 1700 and the thickness difference. The golf club head 1700 in accordance with the exemplary embodiment of the present invention may generally have a Thickness Difference Ratio of greater than 25 degrees/mm, more preferably greater than 27.5 degrees/mm, and most preferably greater than 30 degrees/mm.

Figure 18:
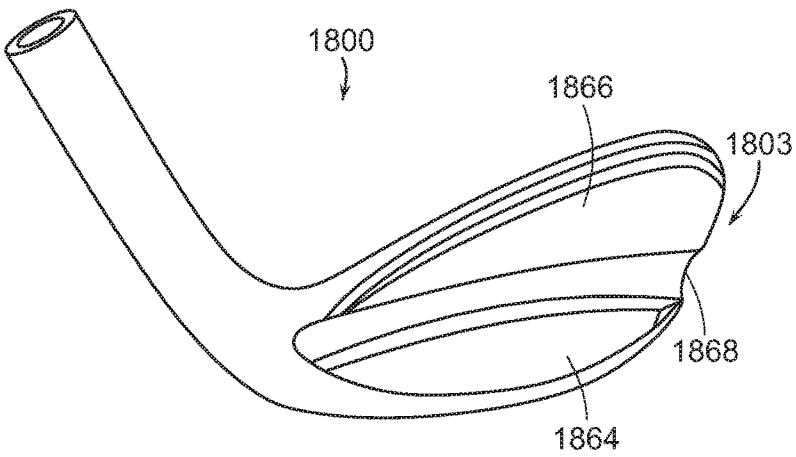
FIG. 18 shows a perspective view of a golf club head in accordance with a further alternative embodiment of the present invention.

FIG. 18 of the accompanying drawings shows a perspective view of a golf club head 1800 in accordance with a further alternative embodiment of the present invention. More specifically, golf club head 1800 may have different geometry for the thickened upper portion 1866 near the top of the backing portion 1803 of the golf club head 1800. In addition to the thickened upper portion 1866, the golf club head 1800 may also have a lower chamber 1864 at the bottom of the backing portion 1803 of the golf club head 1800. Finally, golf club head 1800 may also have a channel 1868 near the center of the backing portion 1803 of the golf club head 1800 between the thickened upper portion 1866 and the lower chamber 1864. The channel 1868 shown in FIG. 18 may generally serve the purpose of accentuating the CG fluctuations due to the thickened upper portion 1866 and the lower chamber 1864 as it removes material from the center of the golf club head 1800.

Figure 19:
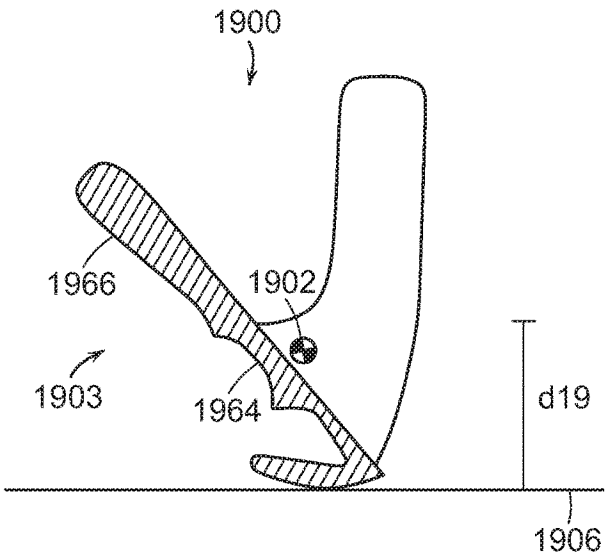
FIG. 19 shows a cross-sectional view of the golf club head shown in FIG. 18.

FIG. 19 of the accompanying drawings shows a cross-sectional view of the golf club head 1800 shown in FIG. 18, taken across the middle of the golf club head 1800. The cross-sectional view of the golf club head 1900 shown in FIG. 19 allows the geometry of the backing portion 1903 to be shown more clearly. It should be noted that in this current exemplary embodiment of the present invention the lower chamber 1964 may be hollow without departing from the scope and content of the present invention. Because the lower chamber 1964 is not filled with a denser material, the CG 1902 location of the golf club head 1900 may be at a distance d19 that is significantly further away from the ground 1906. Distance d19 in this exemplary embodiment of the present invention may be greater than about 18 mm and less than about 22 mm, more preferably greater than 19 mm and less than about 21 mm, more preferably about 21 mm all without departing from the scope and content of the present invention.

Figure 20:
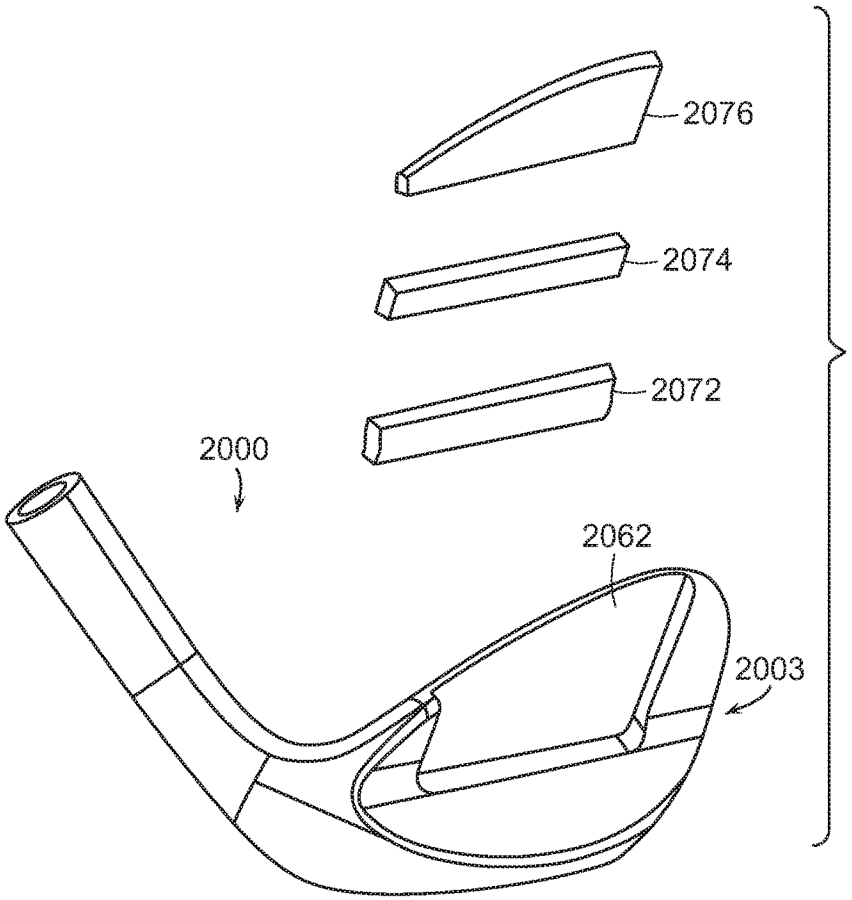
FIG. 20 shows a perspective view of a golf club head in accordance with a further alternative embodiment of the present invention.

FIG. 20 of the accompanying drawings shows a perspective view of a golf club head 2000 in accordance with a further alternative embodiment of the present invention wherein the backing portion 2003 of the golf club head 2000 may contain an oversized upper chamber 2062 that allows multiple inserts to be inserted into the upper chamber 2062. More specifically, the multiple inserts may be comprised of a bottom insert 2072, a central insert 2074, and a top insert 2076. In one exemplary embodiment of the present invention the bottom insert 2072 may be comprised out of a material having a higher density such as tungsten while the central insert 2074 and the top insert 2076 may be comprised out of a material or materials having a lower density in order to create a golf club head 2000 with a lower center of gravity. In an alternative embodiment of the present invention, top insert 2076 may be comprised out of a material having a higher density while the central insert 2074 and the bottom insert 2072 may be comprised out of a material having a lower density to create a golf club head 2000 with a higher density in order to create a golf club head 2000 with a higher center of gravity. In a further alternative embodiment of the present invention, central insert 2074 may be comprised out of a material having a higher density such as tungsten while the bottom insert 2072 and the top insert 2076 may be comprised out of a material or materials having a lower density in order to create a golf club head 2000 with more traditional center of gravity of location.

One advantage of the golf club head 2000 shown in FIG. 20 is that such a golf club head allows its CG location to be changed easily by altering the different materials used to create the inserts. Additionally, although the higher density material discussed above may refer to tungsten, numerous other materials such as tungsten nickel, lead, copper, iridium, or any other material with a high density may all be used without departing from the scope and content of the present invention. Lower density material mentioned above may generally be made out of materials such as 8620 steel, however numerous other materials such as aluminum, iron, copper, titanium, or even plastic may be used so long as it has a density lower than that of the denser material all without departing from the scope and content of the present invention.

Although the present embodiment shows three inserts in order to offer an ability to adjust the CG of the golf club head 2000, numerous other number combinations of inserts may be used without departing from the scope and content of the present invention. More specifically, the golf club head 2000 may have two inserts, four inserts, five inserts, or any number of inserts that can fit within the upper chamber 2062 all without departing from the scope and content of the present invention.

Figure 21:
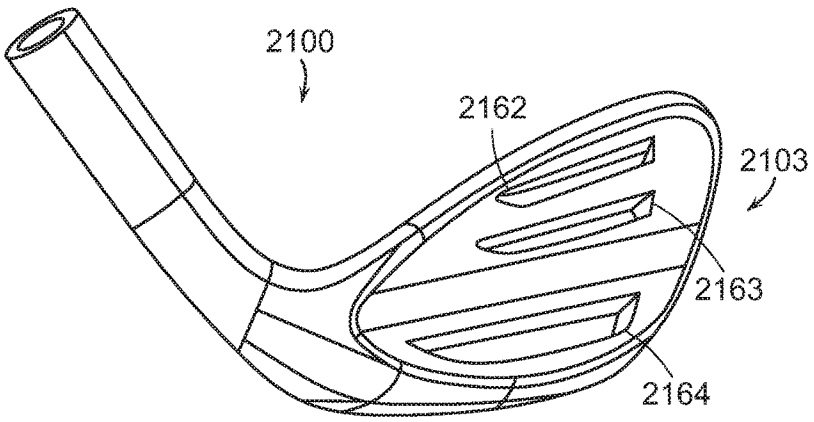
FIG. 21 shows a perspective view of a golf club head in accordance with a further alternative embodiment of the present invention.

FIG. 21 of the accompanying drawings shows a perspective view of a golf club head 2100 in accordance with a further alternative embodiment of the present invention wherein the backing portion 2103 of the golf club head 2100 may contain multiple chambers to help adjust the CG of the golf club head 2100. More specifically, golf club head 2100 may have an upper chamber 2162, a middle chamber 2163, and a lower chamber 2164 to provide a method of adjusting the CG of the golf club head 2100. Similar to the discussion above, different inserts being comprised out of a different material having different density to adjust the CG of the golf club head to change the performance characteristics of the golf club head 2100. Although FIG. 21 shows a golf club head 2100 with three distinct weight chambers, numerous other number of chambers may be used to alter the CG of the golf club head 2100 all without departing from the scope and content of the present invention.

Figure 22:
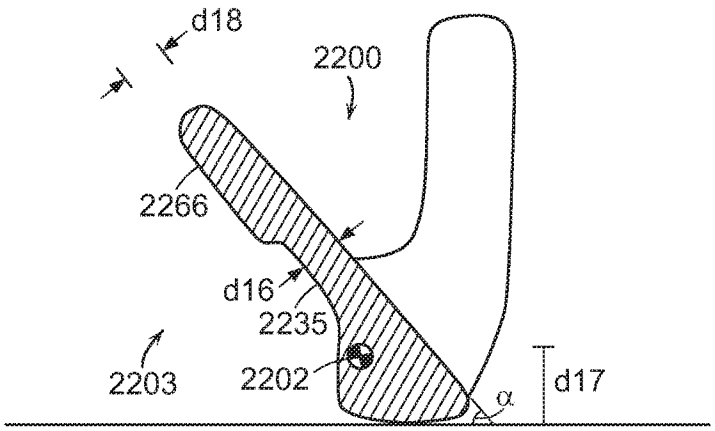
FIG. 22 shows a cross-sectional view of a golf club head in accordance with a further alternative embodiment of the present invention.

Finally, FIG. 22 shows a cross-sectional view of a golf club head 2200 in accordance with a further alternative embodiment of the present invention. More specifically, golf club head 2200 shown here may have a thickened topline portion 2266 and a thinned portion 2235. It should be noted that in this current exemplary embodiment of the present invention, the thickened topline portion 2266 may have a thickness of d18 and the thinned portion may have a thickness of d16 like previously discussed in FIG. 17. Thickness d18 may generally refer to the thickest area near the topline portion of the golf club head 2200 and thickness d16 may generally refer to the thinnest area near the central portion of the golf club head 2200.

Figure 23:
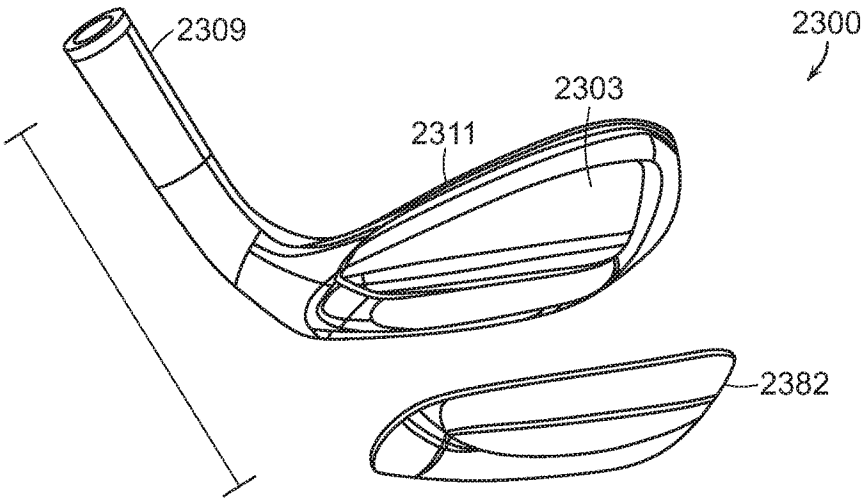
FIG. 23 shows an exploded back view of a golf club head in accordance with an alternative embodiment of the present invention.

FIG. 23 of the accompanying drawings shows an exploded perspective view of a golf club head 2300 in accordance with an alternative embodiment of the present invention. More specifically, FIG. 23 shows a golf club head 2300 having a body portion 2311, including a hosel 2309 and a striking face, and a cover portion 2382 including a sole. In this alternative embodiment of the present invention, the cover portion 2382 may generally have a hollow cavity, allowing mass to be removed and placed in the upper rear portion 2303 of the golf club head.

Figure 24:
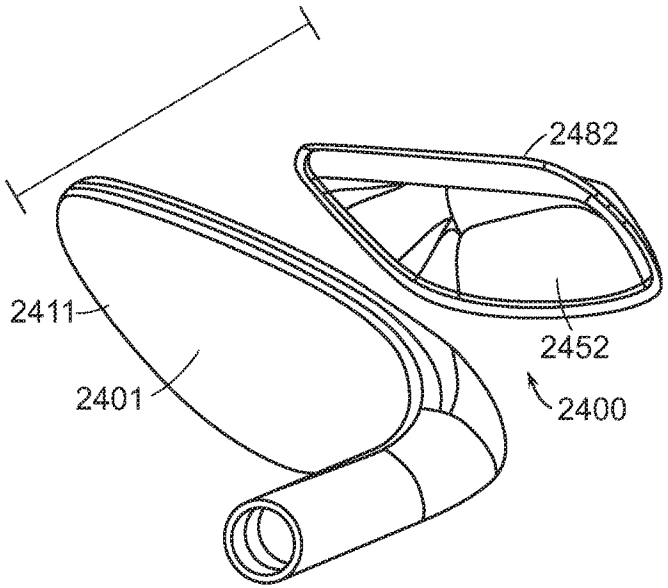
FIG. 24 shows an exploded front view of a golf club head in accordance with an alternative embodiment of the present invention.

FIG. 24 of the accompanying drawing shows an alternative exploded view of a golf club head 2400 in accordance with this alternative embodiment of the present invention, allowing the hollow cavity 2484 of the cover portion 2382 to be shown more clearly. In this embodiment, it can be seen that the cover portion 2382 may generally have cavity volume of greater than about 3500 $mm^3$, more preferably greater than about 3750 $mm^3$, and most preferably greater than about 3900 $mm^3$. The size and volume of the cavity may generally relate to the amount of mass that can be removed from the golf club head 2400, signifying the increase in discretionary weight of the golf club head 2400. In the current alternative embodiment of the invention, the discretionary weight saved from the hollow cavity 2452 of the cover portion 2482 may be moved to thicken up the upper rear portion 2303 (shown in FIG. 23) of the golf club head 2400 to move the center of gravity higher in desirable situation. The cavity portion 2482, in removing material from the sole portion of the golf club head 2400, may generally create a discretionary mass that is greater than about 25 grams, more preferably greater than about 27.5 grams, and most preferably greater than about 30 grams. This discretionary mass, as shown in the figures, may be used to thicken up the upper portion of the body portion 2411 and create a golf club head with a higher center of gravity.

In the current alternative embodiment of the present invention, the cover portion 2482 may be attached to the body portion 2411 via a welding process to ensure proper bonding between the components. However, in other embodiments, the cover portion 2482 may be attached to the body portion 2411 via a swaging process, a mechanical locking process, or even utilizing one or more screws, all without departing from the scope and content of the present invention.

Figure 25:
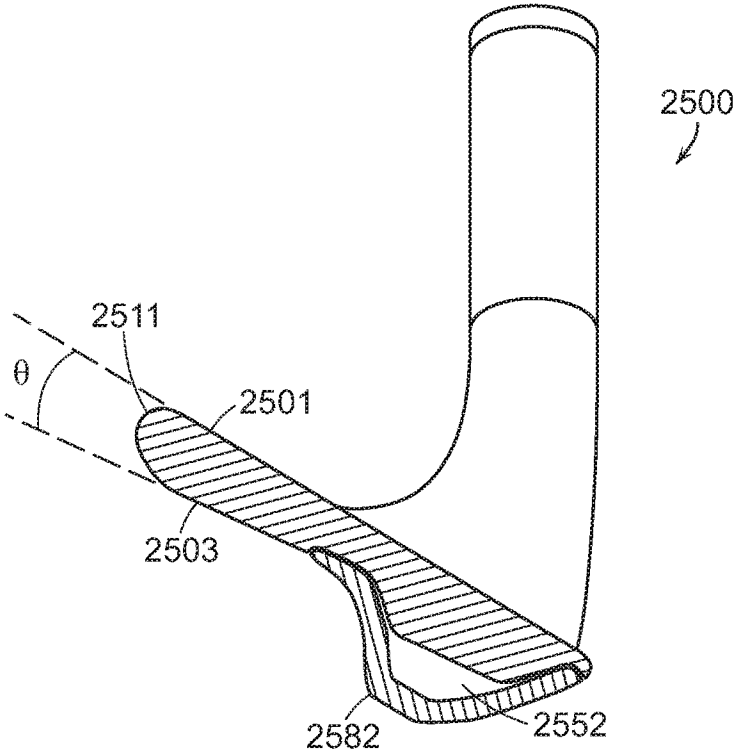
FIG. 25 shows a cross-sectional view of a golf club head in accordance with an alternative embodiment of the present invention.

FIG. 25 of the accompanying drawings shows a cross-sectional view of the golf club head 2500 in accordance with this alternative embodiment of the present invention. More specifically, this cross sectional view shows the interface between the body portion 5211 and the cover portion 2582 as well as the cavity 2552 created by the two components. In addition to the above, FIG. 25 also illustrates a thickened upper body portion 2511, defined by an angle θ created by the striking face 2501 and the rear portion 2503. The angle θ created in this embodiment may generally be between about 3° and about 8°, more preferably between about 4° and about 6.5°, and most preferably about 5° all without departing from the scope and content of the present invention. The angle θ is important to the present invention because it helps incorporate the weight removed from the sole portion via the cavity 2552 to the upper body portion in a seamless and aesthetically appealing manner with a smooth transition.

Figure 26:
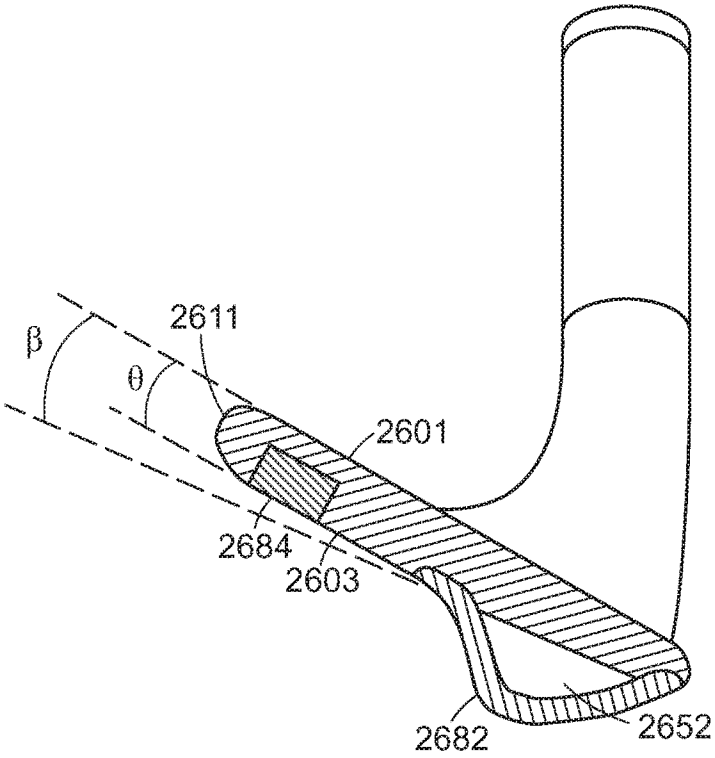
FIG. 26 shows a cross-sectional view of a golf club head in accordance with an alternative embodiment of the present invention.

FIG. 26 of the accompanying drawings shows a cross-sectional view of a golf club head 2600 in accordance with a further alternative embodiment of the present invention. Although this embodiment of the present invention may look very similar to the prior embodiment, a closer examination of FIG. 26 will show that this embodiment of the present invention creates more volume in the cavity 2652 than previously via an adjustment of the angle β of the bottom of the body portion 2611. As it can be seen, the angle θ of the upper portion of the back 2603 of the body portion

2611 is generally the same as before, but the change in the bottom angle β will yield an increase in the volume of the cavity 2652 to be greater than about 3500 $mm^3$, more preferably greater than about 3750 $mm^3$, and most preferably greater than about 3900 $mm^3$.

It should be noted that golf club head 2600 shown in FIG. 26 also differ from previous embodiments of the present invention in that it comprises a heavy weighted portion 2684 attached to the thick topline portion of said golf club head 2600. The heavy weighted portion 2684 may generally help raise the center of gravity even higher in this particular embodiment, further increasing stability and performance of the golf club head 2600. The heavy weighted portion 2684, in the current exemplary embodiment, may be made out of a tungsten material. However, numerous other materials such as lead, heavy weighted steel, or any other material capable of having a higher density than material used to form the body, may be used to create the heavy weighted portion 2684 all without departing from the scope and content of the present invention.

Figure 27:
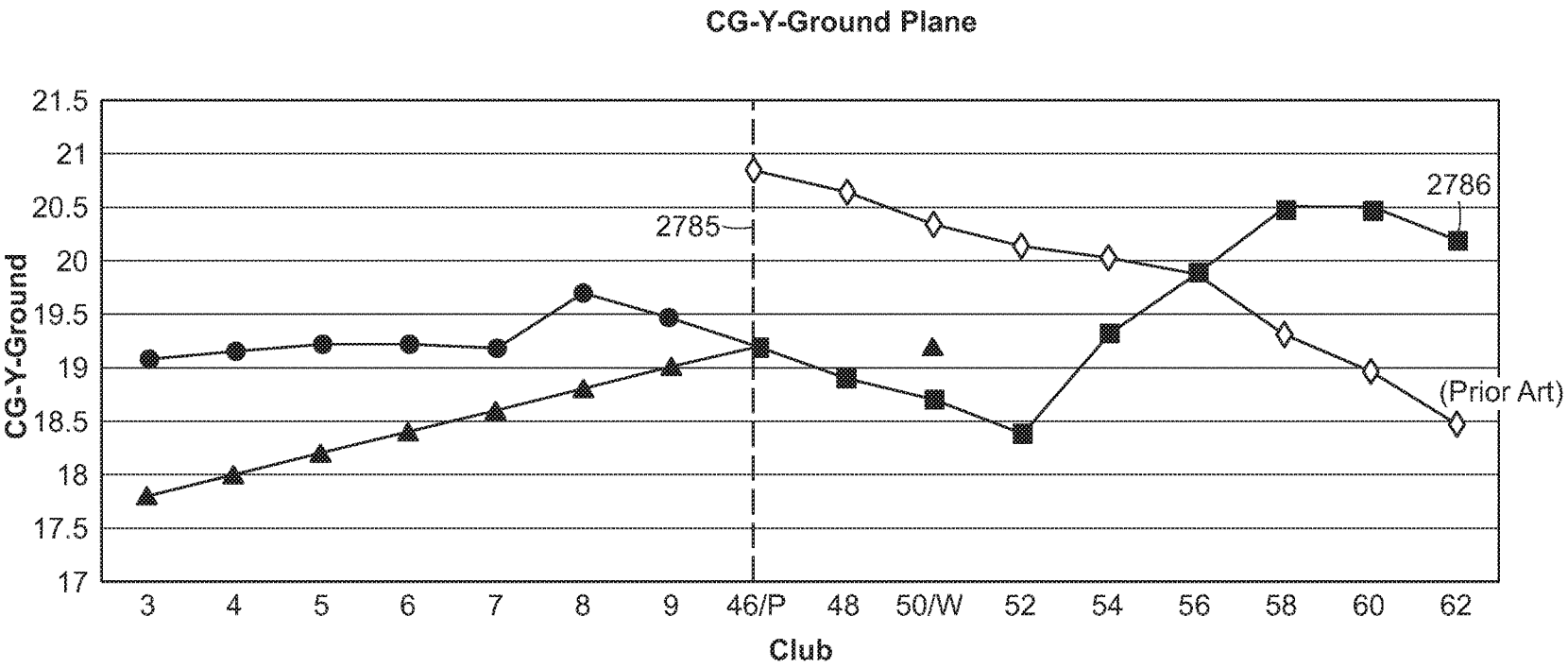
FIG. 27 shows a graphical relationship between the center of gravity locations of different golf club heads ranging from irons to wedges.

Ultimately, these all these alternative embodiment of the golf club head allows the golf club designer a significant amount of discretion to tailor the center of gravity of the location of a golf club head depending on the needs of the specific golf club. Here, in FIG. 27 a graph is provided to indicate how the center of gravity of a golf club head can be adjusted to achieve different needs. In one scenario, it may be desirable to lower the center of gravity of a wedge type golf club to match the center of gravity of an iron near the iron wedge merge line 2785, hence utilizing designs that could lower the center of gravity of a golf club head as described in FIGS. 7, 8, 9, and 12. In another scenario, it may be desirable to raise the center of gravity of a wedge type golf club head to create more stability in the golf club head having a higher loft, hence utilizing designs that could raise the center of gravity as described in FIGS. 12, 15, 17, 19, 22, 25, and 26. Ultimately, line 2786 indicates the CG progression of the current inventive golf club head that will yield the most performance gains for the various types of shots needed from different wedges.

In addition to adjusting the center of gravity of a golf club head, it may also be beneficial to adjust the groove width and depth of a wedge type golf club head depending on the loft. In one exemplary embodiment of the present invention, wedges that have a lower loft of less than 54° may have deeper and narrower grooves to provide improvement in consistency; while wedges that have a higher loft of greater than 56° may have wider and shallower grooves to prove extreme spin. More specifically, lower lofted wedges may generally have a groove width of about 0.0262 inches and a groove depth of about 0.0176 inches; while higher lofted wedges may generally have a groove width of about 0.0283 inches and a groove depth of about 0.0156 inches.

Other than in the operating examples, or unless otherwise expressly specified, all of the numerical ranges, amounts, values and percentages such as those for amounts of materials, moment of inertias, center of gravity locations, loft and draft angles, and others in the preceding portions of the specification may be read as if prefaced by the word "about" even though the term "about" may not expressly appear with the value, amount, or range. Accordingly, unless indicated to the contrary, the numerical parameters set forth in the preceding specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited value may be used.

It should be understood, of course, that the foregoing relates to exemplary embodiments of the present invention and that modifications may be made without departing from the spirit and scope of the invention as set forth in the following claims.

What is claimed is:

1. A plurality of two or more golf club heads comprising:

a first golf club head having a first loft angle and a first CG-y location;

a second golf club head having a second loft angle and a second CG-y location;

wherein both said first loft angle and said second loft angle are greater than about 45 degrees, wherein said first loft angle is smaller than said second loft angle;

wherein said first CG-y location is lower to or equal to said second CG-y location; said CG-y location defined as a distance of a CG location along an y-axis from a ground plane wherein said second golf club head further comprises a thickened topline portion having a first thickness, a thinned central portion having a second thickness, and a hollow cavity located near a sole of said second golf club head, and wherein said second golf club head has a Topline Thickness Ratio of greater than about 6.0 degrees/mm and less than about 9.0 degrees/mm; said Topline Thickness Ratio defined as said loft angle of said second golf club head divided by a thickness of said thickened topline portion.

2. The plurality of two or more golf club heads of claim 1, wherein said first CG-y location is greater than about 14 mm and less than about 20 mm and said second CG-y location is greater than about 18 mm and less than about 22 mm.

3. The plurality of two or more golf club heads of claim 2, wherein said first CG-y location is greater than about 17 mm and less than about 19 mm, and said second CG-y location is greater than about 19 mm and less than about 21 mm.

4. The plurality of two or more golf club heads of claim 3, wherein said first CG-y location is about 18 mm and said second CG-y location is about 21 mm.

5. The plurality of two or more golf club heads of claim 1, wherein said hollow cavity located near said sole of said second golf club head has a volume of greater than about 3500 $mm^3$.

6. The plurality of two or more golf club heads of claim 5, wherein said hollow cavity located near said sole of said second golf club head has a volume of greater than about 3750 $mm^3$.

7. The plurality of two or more golf club heads of claim 6, wherein said hollow cavity located near said sole of said second golf club head has a volume of greater than about 3900 $mm^3$.

8. The plurality of two or more golf club heads of claim 1, wherein said Topline Thickness Ratio of said second golf club head is greater than about 7.0 degrees/mm and less than about 9.0 degrees/mm.

9. The plurality of two or more golf club heads of claim 8, wherein said Topline Thickness Ratio of said second golf club head is greater than about 8.0 degrees/mm and less than about 9.0 degrees/mm.

* * * * *